US008027602B2

(12) United States Patent
Kuroki et al.

(10) Patent No.: US 8,027,602 B2
(45) Date of Patent: Sep. 27, 2011

(54) BELT FEEDING DEVICE AND IMAGE HEATING DEVICE WITH SETTING MEANS FOR SWITCHING INCLINATION ANGLE OF SUPPORTING MEMBER

(75) Inventors: Kenji Kuroki, Toride (JP); Hiroyuki Eda, Moriya (JP); Takashi Fujimori, Moriya (JP); Hiroaki Tomiyasu, Toride (JP); Hidenori Matsumoto, Kashiwa (JP); Junichi Endo, Kitasohma-gun (JP); Hajime Kaji, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/193,966

(22) Filed: Aug. 19, 2008

(65) Prior Publication Data

US 2008/0317525 A1 Dec. 25, 2008

Related U.S. Application Data

(62) Division of application No. 11/691,741, filed on Mar. 27, 2007, now Pat. No. 7,430,393.

(30) Foreign Application Priority Data

Jul. 3, 2006 (JP) ..... 2006-183786

(51) Int. Cl.
*G03G 15/00* (2006.01)

(52) U.S. Cl. ..... 399/36; 399/126; 399/165; 399/329

(58) Field of Classification Search ..... 399/33, 399/36, 67, 122, 126, 165, 320, 329
See application file for complete search history.

(56) References Cited

U.S. PATENT DOCUMENTS

| | | | | | |
|---|---|---|---|---|---|
| 4,961,089 | A | * | 10/1990 | Jamzadeh | 399/165 |
| 5,027,160 | A | * | 6/1991 | Okada et al. | 399/329 |
| 5,343,279 | A | * | 8/1994 | Nagata et al. | 399/329 |
| 5,471,289 | A | * | 11/1995 | Satoh et al. | 399/328 |
| 5,964,339 | A | * | 10/1999 | Matsuura et al. | 198/810.03 |
| 6,088,558 | A | * | 7/2000 | Yamada et al. | 399/165 |
| 6,141,526 | A | * | 10/2000 | Ikeda | 399/395 |
| 6,321,052 | B1 | * | 11/2001 | Yamashina et al. | 399/165 |

(Continued)

FOREIGN PATENT DOCUMENTS

JP 11-194647 7/1999

(Continued)

OTHER PUBLICATIONS

Office Action in Chinese Patent Application No. 200710091477.5, dated Nov. 28, 2008, with translation.

*Primary Examiner* — David Gray
*Assistant Examiner* — Geoffrey Evans
(74) *Attorney, Agent, or Firm* — Fitzpatrick, Cella, Harper & Scinto

(57) ABSTRACT

A belt feeding apparatus includes an endless belt and a supporting member for rotatably supporting the belt. The belt feeding apparatus further includes a setting member for setting, when the belt is deviated from a widthwisely normal zone, an inclination angle of the supporting member to a return angle to return the belt toward the normal zone. The setting member also sets, when a predetermined time elapses from the belt returning to the normal zone, the inclination angle of the supporting member to a balance angle to keep the belt in the zone.

15 Claims, 13 Drawing Sheets

U.S. PATENT DOCUMENTS

| | | | | |
|---|---|---|---|---|
| 6,327,444 | B1 * | 12/2001 | Hachisuga | 399/45 |
| 6,628,909 | B2 * | 9/2003 | Monahan et al. | 399/116 |
| 6,804,486 | B2 * | 10/2004 | Lee et al. | 399/165 |
| 6,865,358 | B2 | 3/2005 | Lee | 399/167 |
| 7,430,393 | B2 * | 9/2008 | Kuroki et al. | 399/329 |
| 2002/0034400 | A1 * | 3/2002 | Asuwa et al. | 399/165 |
| 2005/0063732 | A1 * | 3/2005 | Ito | 399/165 |
| 2006/0083562 | A1 | 4/2006 | Matsumoto et al. | 399/329 |
| 2006/0133869 | A1 | 6/2006 | Sata | 399/329 |
| 2008/0003028 | A1 | 1/2008 | Kuroki et al. | 399/329 |
| 2008/0003029 | A1 | 1/2008 | Fujimoro et al. | 399/329 |
| 2011/0026989 | A1 * | 2/2011 | Chiba | 399/329 |

FOREIGN PATENT DOCUMENTS

| | | |
|---|---|---|
| JP | 2004-341346 | 12/2004 |

* cited by examiner (a)

(b)

BELT FEEDING DEVICE AND IMAGE HEATING DEVICE WITH SETTING MEANS FOR SWITCHING INCLINATION ANGLE OF SUPPORTING MEMBER

This is a divisional of co-pending U.S. patent application Ser. No. 11/691,741, filed Mar. 27, 2007.

FIELD OF THE INVENTION

The present invention relates to a belt feeding device for rotating an endless belt, and an image heating device using it.

As such an image heating device, there are known a fixing device for fixing an unfixed image on a recording material, a glossiness increasing device for heating the image fixed on the recording material, thus increasing the glossiness of the image, and so on, for example. Such an image heating device is used in an image forming apparatus, such as a copying machine of an electrophotographic type, a printer, and a facsimile machine and so on.

RELATED ART

In the image forming apparatuses, such as an electrophotographic apparatus and an electrostatic recording apparatus, an unfixed toner image is formed on a sheet-like recording material, and the toner image is heated and pressed by a fixing device, so that the toner image is fixed on the recording material.

Heretofore, a device of a roller type fixing device and a device of a belt fixing type are employed as such a fixing device.

In a fixing device of the roller type, a pressing roller is press-contacted to a fixing roller which includes a heater therein to form a fixing nip wherein the toner image is fixed on the recording material in the formed fixing nip.

In order to accomplish a glossiness enhancement and an improvement in the speed of an image formation, it is preferred to fully melt the toner by lengthening the fixing nip, but in the case of the roller type fixing device, there is a tendency for the device to upsize.

In view of this, a fixing device of the belt fixing type with which the fixing nip is longer without the necessity of upsizing the device as compared with the roller type fixing device is desired (Japanese Laid-open Patent Application Hei 11-194647). More specifically, the fixing nip is formed between the fixing roller and a pressing belt, and therefore, the fixing nip is long.

In the fixing device of the belt fixing type, the phenomenon that the belt offsets toward a one lateral end or the other lateral end during the rotation of the belt ("snaking movement", hereafter) will be produced. Therefore, in such the fixing device, the belt disengages from a roller which supports the belt, or the end of the belt is damaged due to the snaking movement of the belt, and in order to prevent these defects, the problem of the snaking movement of the belt has been one of the important technical problems.

In the device disclosed in Japanese Laid-open Patent Application Hei 11-194647, in order to correct the snaking movement of the belt, one of the stretching-the belt rollers is inclined so that the belt is positively swung in the widthwise direction thereof. Hereinafter, such a control is called a "swing-type-control". The roller inclined is called a "steering roller".

More specifically, when the belt shifts toward one of the lateral end portion, the steering roller is inclined positively, so that the belt shifts toward the other one of the lateral end portion. On the other hand, if the belt shifts toward the other lateral end, the steering roller is inclined in an opposite direction, so that the belt shifts toward said one lateral end. By repeatedly carrying out such a control, the belt can be swung within a certain range.

In the case of above described "swing-type-control", the belt will always move in the widthwise direction thereof, the belt slides relative to a stretching rollers and fixing roller with this movement with the possible result of deteriorations of these members.

When the "swing-type-control" stated above in the fixing device using a fixing belt and a pressing belt as disclosed in Japanese Laid-open Patent Application 2004-341346 is employed, there is liability that one of the belts may give an excessive snaking force against the other one of the belts.

In other words, when the "swing-type-control" is employed for both of belts, and if the direction of the snaking force given from the other one of the belts is opposite to the direction of a snaking motion correction provided by off-set control for said one of the belts, there is liability that the snaking motion correcting force may be cancelled out. As a result, the snaking movement may not fully be eliminated even to such an extent of the possibility that said one of the belts will shift completely, by being dragged by the other one of the belts.

SUMMARY OF THE INVENTION

Accordingly, it is a principal object of the present invention to provide a belt feeding device which can stabilize and feed the belt while suppressing the deterioration of the belt.

It is another object of the present invention to provide an image heating device which can stabilize and feed the belt while suppressing the deterioration of the belt.

According to an aspect of the present invention, there is provided a belt feeding apparatus comprising an endless belt; a supporting member for rotatably supporting the belt; setting means for setting, when said belt is deviated from a widthwisely normal zone, an inclination angle of said supporting member to a return angle to return said belt toward the normal zone, and for setting, when a predetermined time elapses from said belt returning to the normal zone, the inclination angle of said supporting member to a balance angle to keep said belt in said zone.

These and other objects, features and advantages of the present invention will become more apparent upon consideration of the following description.

DESCRIPTION OF THE PREFERRED EMBODIMENT

An image forming station of an image forming apparatus which employs a belt feeding device (an image heating device) according to an embodiment of the present invention will be described, in conjunction with accompanying drawings.

(1) Image Forming Station

Figure 2:
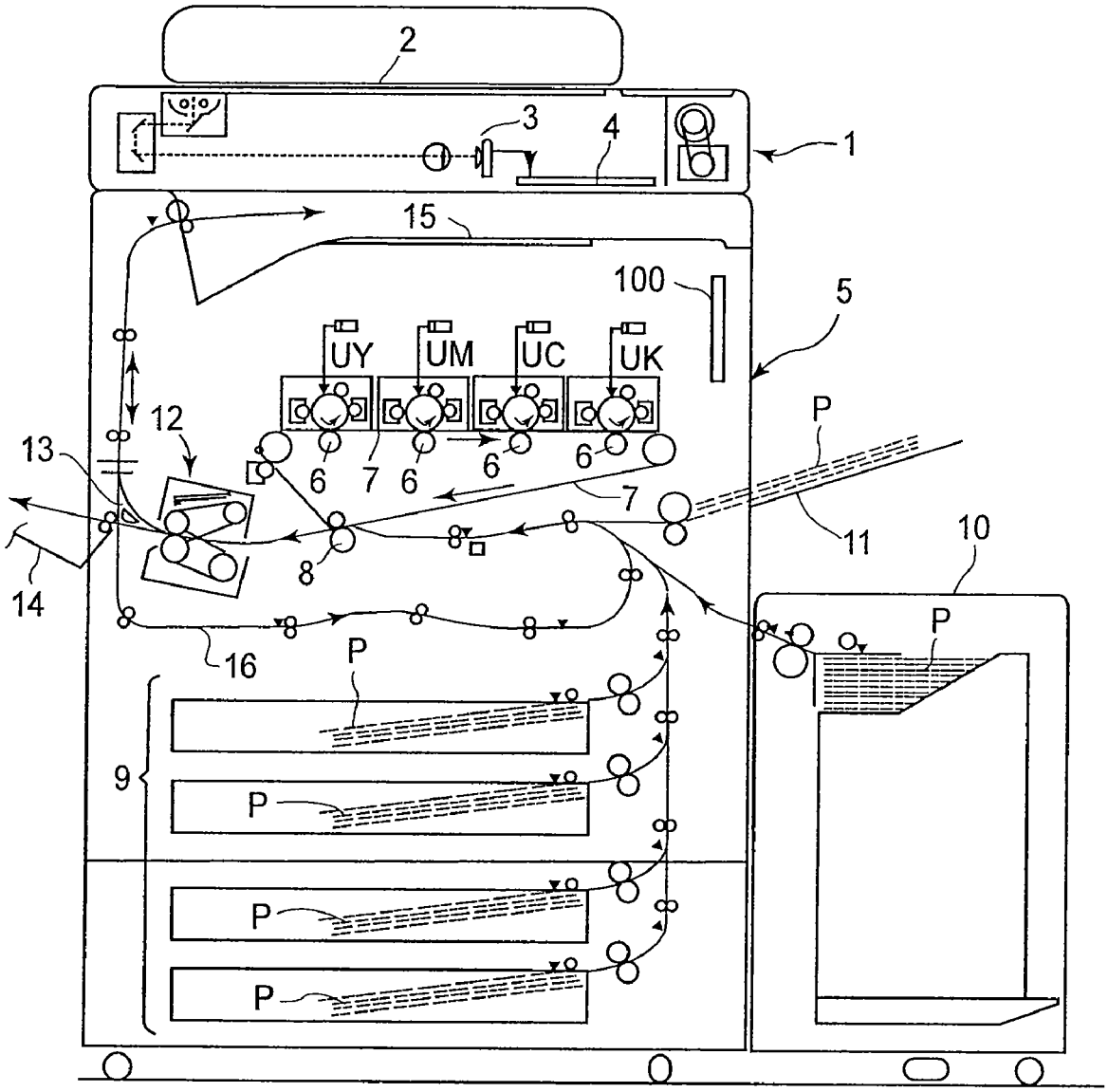
FIG. 2 is a sectional view showing a general arrangement of an example of the image forming apparatus.

FIG. 2 is a longitudinal sectional view of an electrophotographic full-color copying machine which is an example of the image forming apparatus which includes the belt feeding device (the image heating device) according to an embodiment of the present invention. The image forming station will be described.

Designated by 1 is a digital color image reader and which reads photoelectrically the image of a color original placed on an original supporting platen glass 2 into a color separation signal by a full-color sensor (CCD 3). The color separation signal is subjected to a signal processing by the image processing station 4, and thereafter, it is fed to a control circuit portion (it is hereafter described as CPU 100) of the digital color image printer 5.

In the printer station 5, designated by UY, UM, UC, UK are four image forming stations (first to fourth stations). Each image forming station comprises an electrophotographic processing mechanism of a laser exposure type. In each image forming station, a color toner image is formed on a surface of a rotating electrophotographic photosensitive drum at the predetermined timing controlled based on the color separation signal fed to the CPU 100 from the image processing station 4. More particularly, a yellow toner image is formed in the first image forming station UY, a magenta toner image is formed in the second image forming station UM, a cyan toner image is formed in the third image forming station UC, and a black toner image is formed in the fourth image forming station UK.

The structure and an image forming operation of the electrophotographic processing mechanism of each image forming station are well-known, and therefore, the further description is omitted.

The toner image of each color formed in each image forming station is transferred superimposingly sequentially onto an intermediary transfer belt 7 rotated in a clockwise direction of arrow in the primary tranfser portion 6. By this, an unfixed full-color toner image is formed on the belt 7.

Thereafter, the full-color toner image is transferred, in a secondary transfer portion 8, all together onto a recording material P fed at the controlled predetermined timing from a cassette type sheet feeding mechanism 9, a sheet seeing deck 10, or a manual feed portion 11 secondary transfer.

Then, the recording material P is separated from the belt 7, subsequently, is introduced into the belt type image fixing device 12 as the image heating device, and, thereafter, is nipped and fed by the fixing nip. In the process of the nipping and feeding thereof, the unfixed full-color toner image melts and mixes in color by the heat and the pressure, so that it is fixed on the surface of the recording material P into a full-color fixed image. The recording material P discharged from the belt type image fixing device 12 is subjected to path switching by the flapper 13, and thereafter, it is discharged onto FU (face-up) sheet discharge tray 14 or FD (face-down) sheet discharge tray 15, so that a series of image forming operations finish.

When a double-side-print mode is selected, the recording material P which passed the belt type image fixing device 12 is fed to a sheet passage connected with a paper output tray 15 by a flapper 13. The recording material P is switched back, and subsequently, it is guided to the refeeding sheet passage 16, and is introduced into the secondary transfer portion 8, again. By this, the toner image is transferred by the secondary transfer operation onto second side of the recording material P. Thereafter, the recording material P is introduced into the belt type image fixing device 12 and a fixing operation is carried out for the second surface, and thereafter, the double-side-printed recording material is discharged onto FU sheet discharge tray 14 or FD sheet discharge tray 15.

Figure 1:
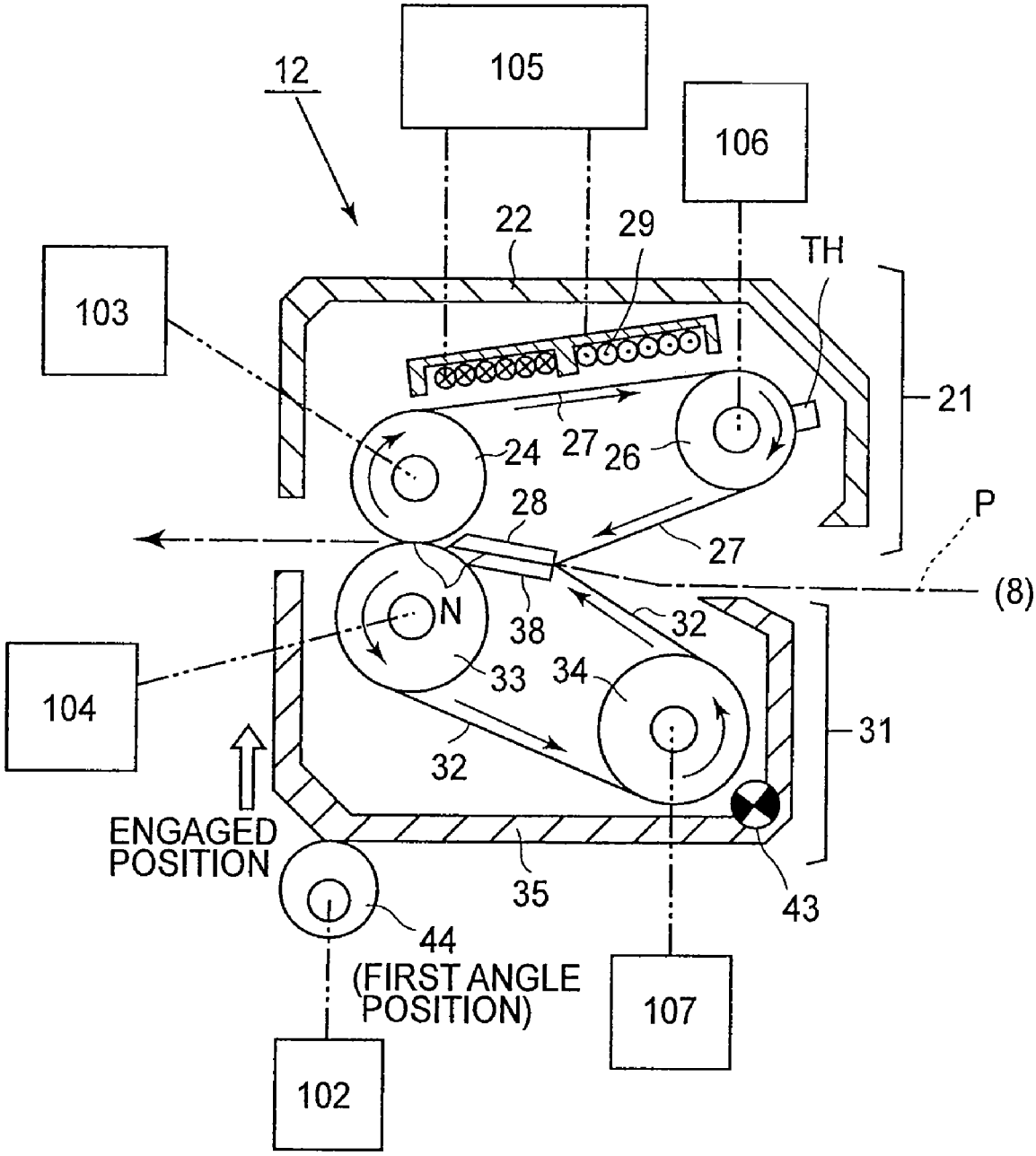
FIG. 1 is a sectional view of an image fixing apparatus according to an embodiment of the present invention.

(2) Belt Type Image Fixing Device:

FIG. 1 is a schematic cross-sectional view of the fixing device (also called "image heating device") 12 which includes the belt feeding device. The fixing device 12 includes a belt feeding device of a twin-belt type which includes a first endless belt and a second endless belt which are press-contacted rotatably to each other.

In the following descriptions, with respect to the fixing device 12, the front side is the front of the device as seen from a recording material entrance side. Right and left are the left or the right, seeing the fixing device 12 from the front side. The upstream and downstream sides are the upstream and downstream sides with respect to direction of the recording material feeding. The widthwise direction is the direction parallel with the direction perpendicular to the direction of the recording material feeding in the surface of the sheet passage, the width is the dimension measured in the direction parallel with the direction perpendicular to the direction of the recording material feeding in the surface of the sheet passage.

The fixing device 12 includes a fixing unit 21 and a pressing unit 31 which are arranged up and down direction.

The unit 21 provided inside the casing 22 is an assembly incorporating a fixing belt 27 as a first endless belt, a driving roller 24, a steering roller 26 as a supporting member, a pressing pad 28, an induction heating coil 29, and so on.

The driving roller 24 (belt stretching member) has a function of rotating and stretching the fixing belt 27. The roller 24 is rotatably supported between the left and right side plates of the casing 22 by bearings provided in the left and right side plates thereof, respectively.

The steering roller 26 (supporting member) includes the function of controling the position of the fixing belt 27 with respect to the widthwise direction thereof while stretching the fixing belt 27. A roller 26 is rotatably supported between the left and right side plates of the casing 22 by bearings provided in the left and right side plates, respectively. The roller 26 can change the inclination (attitude, orientation or pose thereof) by displacing, about one longitudinal end side, the other end side as will be described hereinafter.

The fixing belt 27 is extended around the rollers 24, 26, as shown in the Figures. In this embodiment, the fixing belt 27 is heated by electromagnetic induction heating by the induction heating coil 29 as a heating source. For example, the fixing belt 27 includes a magnetic metal layers, such as a nickel layer or a stainless steel layer, having 75 μm in thickness, 380 mm in width, and the circumferential length of 200 mm as, a belt base layer. And it further includes a 300-μm-thick silicon rubber layer on the outer surface thereof.

The pressing pad 28 is provided contacted to the inner surface of the fixing belt 27, and the left and right opposite ends thereof are supported by the left and right side plates of the casing 22, respectively. The pad 28 has a function of pressing the fixing belt 27 to the pressing belt in the inner side thereof in the neighborhood of the driving roller 24.

The induction heating coil 29 is a combination of a litz coil wound into a flat elongated shape, and a plate-like magnetic core, and it is supported by the casing 22 so as to oppose to the outer surface of the fixing belt 27 with a gap therebetween.

The steering roller 26 also has the function as the tension roller which gives the tension to the fixing belt 27 by urging left and right bearing thereof away from the driving roller 24 by the spring member.

The pressing unit 31 is an assembly which comprises a pressing belt 32 as a second endless belt, a driving roller 33, a steering roller 34 as a supporting member, a pressing pad 38, and so on inside the casing 35.

The driving roller 33 (belt stretching member) has the function of stretching and rotating the pressing belt 33. The roller 33 is rotatably supported between the left and right side plates of the casing 35 by bearings provided in the left and right plates thereof, respectively.

The steering roller 34 as the supporting member has a function of stretching the pressing belt 27 and controling the position thereof with respect to the widthwise direction thereof. The roller 34 is rotatably supported by the bearing between the left and right side plates of the casing 35 at the left and right opposite end shaft portions thereof, respectively. The roller 34 can change the inclination (attitude, orientation or pose thereof) by displacing, about one longitudinal end side, the other end side as will be described hereinafter.

The pressing belt 32 is extended around these rollers 33, 34.

The pressing pad 38 is provided contacted to the inner surface of the pressing belt 32, and the left and right ends thereof are supported by the left and right side plates of the casing 35, respectively. The pressing pad 38 has a function of pressing the inner side of the pressing belt 32 to the fixing belt, in the neighborhood of the driving roller 33.

The steering roller 34 also has a function as the tension roller which gives the tension in the pressing belt 32, by the spring member urging the left and right bearings away from the driving roller 33.

The pressing unit 31 is swingable in an up-down direction about the mounting-dismounting shaft portion 43, and, it is supported by abutting the lower surface of the casing 35 to the eccentric cam 44. As for the eccentric cam 44, the drive control of the half-rotation is carried out by the driving mechanism 102 for the belt mounting and demounting, so that it is switched between a rotation angle position where large diameter cam portion is faced up and a second rotation angle position where a small diameter cam portion is faced up.

The eccentric cam 44 is switched to the first rotation angle position, so that the unit 31 moves up about the mounting-dismounting shaft portion 43. By this, as shown in FIG. 1, the driving roller 33 sandwiches the pressing belt 32 and the fixing belt 27 between the driving roller 24 of the unit 21 and itself. The pressing pad 38 sandwiches the pressing belt 32 and the fixing belt 27 between the pressing pad 28 of the unit 21 and itself.

The state of FIG. 1 is an engaged state between the unit 21 and the unit 31. In this engaged state, the fixing belt 27 and the pressing belt 32 are press-contacted between the driving roller 24 and the driving roller 33, so that a wide fixing nip N is formed between the pressing pad 28 and the pressing pad 38 with respect to the sheet feeding direction. Such a state is the state in which the fixing operation is possible.

Figure 3:
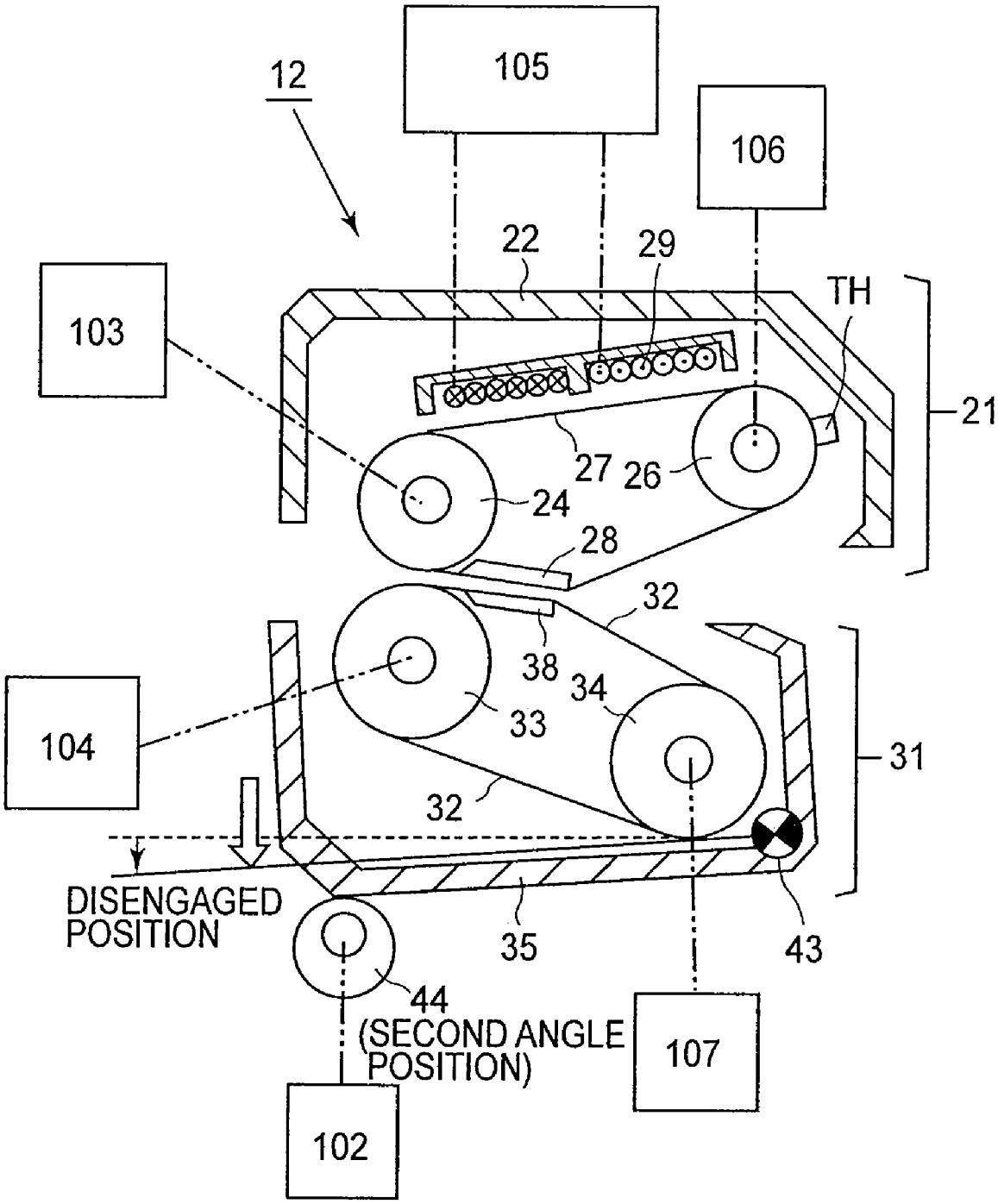
FIG. 3 is a cross-sectional view of the fixing device which is in a disengaged state.

On the other hand, the unit 31 is downwardly moved about the mounting-dismounting shaft portion 43 by switching the eccentric cam 44 to the second rotation angle position. By this, the pressing of the driving roller 33 and the pressing pad 38 against the driving roller 24 and the pressing pad 28 is released, so that as shown in FIG. 3, the pressing belt 32 is spaced from the fixing belt 27. The state of FIG. 3 is the disengaged state between the unit 21 and the unit 31. The fixing operation cannot be carried out with such a state, and it is the state of standby.

In an operation control of the image forming apparatus, the CPU 100, at the time of the operation of the fixing device 12 (in nipping and feeding the recording material) by the fixing nip, the eccentric cam 44 is switched to the first rotation angle position as shown in FIG. 1 by the driving mechanism 102, and the units 21, 31 are retained in the engaged state.

The CPU 100, during non-operating period of the fixing device 12, (that is, the case other than the case of nipping and feeding the recording material by the fixing nip), the eccentric cam 44 is switched to the second rotation angle position as in FIG. 3 with the driving mechanism 102, and the units 21, 31 are retained in the disengaged state. By this, both of the units 21, 31 are prevented from the unnecessary pressure applied between them, so that the wearing of the members can be avoided.

The belt mounting-dismounting mechanism may comprise an electromagnetic solenoid plunger mechanism or a lever mechanism in place of above described cam mechanism.

The CPU 100 actuates the driving mechanism 103 for the driving roller for fixing, and the driving mechanism 104 for the driving roller for pressing, at the time of the operation of the fixing device 12. The driving roller 24 is rotated in the clockwise direction indicated by arrow in FIG. 1 at the predetermined speed by actuation of the driving mechanism 103. The fixing belt 27 rotates in the clockwise direction indicated by arrow by the rotation of the roller 24. At this time, the steering roller 26 is rotationally driven by the rotation of the fixing belt 27.

The driving roller 33 is rotated in the clockwise direction shown by arrow at the predetermined speed by actuation of the driving mechanism 104. The pressing belt 32 rotates counter-clockwisely as indicated by an arrow by the rotation of the roller 33. The steering roller 34 is rotated by being driven by the rotation of the pressing belt 32. Here, the peripheral speeds of the driving rollers are set so that the rotational speed of the fixing belt 27 and the rotational speed of the pressing belt 32 are substantially the same.

The CPU 100 actuates an excitation circuit 105 to apply a high frequency current to the induction heating coil 29. By this, a metal layer of the fixing belt 27 effects the induction heat generation by which the fixing belt is heated. A surface temperature of the fixing belt 27 is sensed by the temperature detecting elements TH, such as thermistor, and the electrical information about the temperature of the fixing belt 27 is inputted to CPU 100. On the basis of the temperature information inputted from the temperature detecting element TH, the CPU 100 controls an electric power supply from the excitation circuit 105 to the induction heating coil 29 so that the temperature of the fixing belt is the predetermined fixing temperature.

In the state where the fixing belt 27 is started and is subjected to the temperature control for the predetermined fixing temperature, the recording material P which carries an unfixed toner image is introduced from the secondary transfer portion 8 into the fixing device 12. The recording material P is introduced into the fixing device 12 by the state where the surface with the unfixed toner image faces the fixing belt. And, the recording material P is nipped and fed by the fixing nip N which is a press-contacting portion between the fixing belt 27 and the pressing belt 32, so that the unfixed toner image is fixed by heat and pressure on the recording material.

(3) Belt Off-Set Controlling Mechanism:

The belt off-set controlling mechanism controls the offsetting movement in the widthwise direction produced during rotation of the fixing belt 27 and the pressing belt 32 in the fixing unit 21 and the pressing unit 31, respectively.

In this embodiment, in each of the units 21, 31, the inclination (inclination angle, attitude or orientation) of the steering roller 26, 34 is controlled by the CPU 100 as functioning setting means (the steering control). More particularly, the position of the belt is controlled with respect to the widthwise direction by adjusting alignment (an orientation or a parallelism or the like) of the steering roller 26, 34) relative to the driving roller 24, 33.

Figure 4:
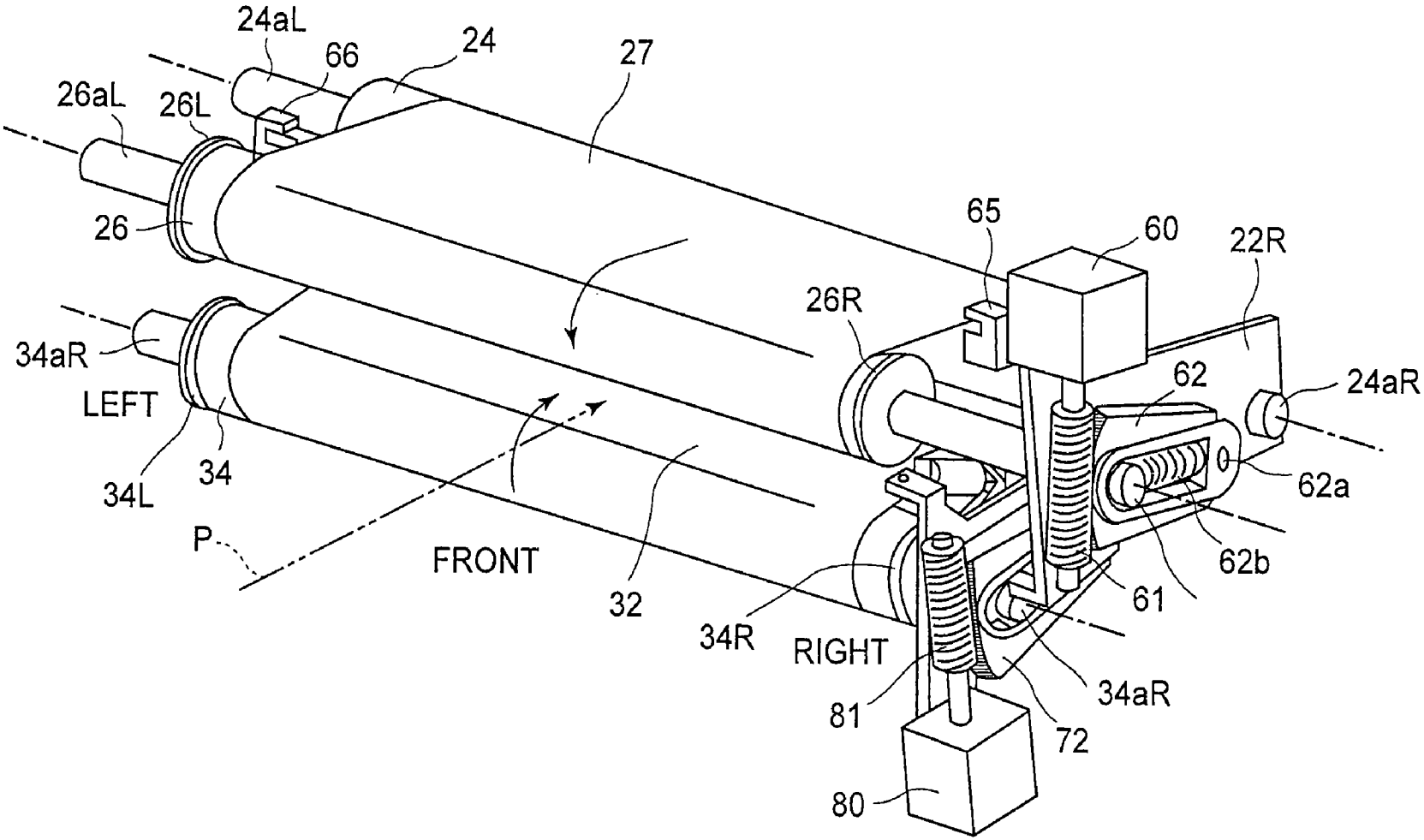
FIG. 4 is a schematic perspective view of a major part of the fixing device.
Figure 5:
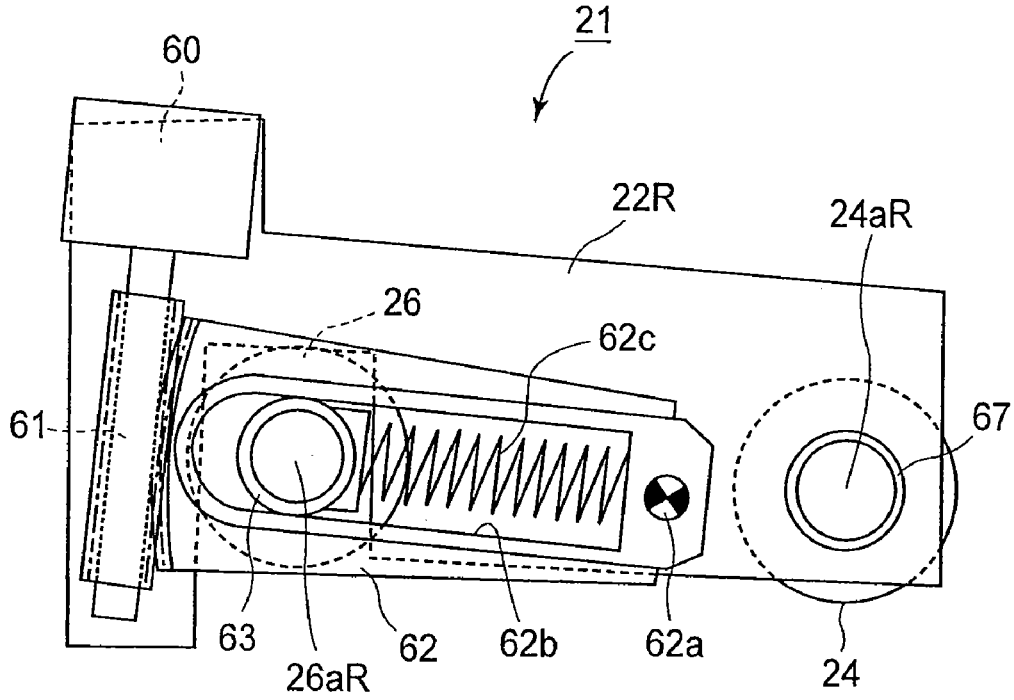
FIG. 5 is a right side view of the fixing unit.
Figure 6:
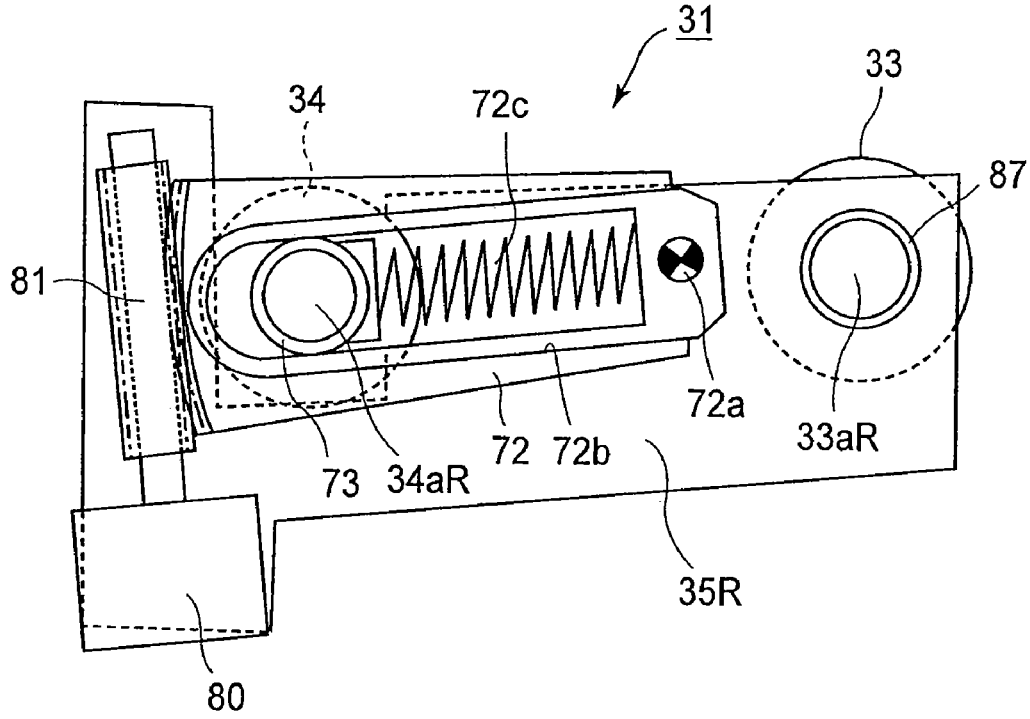
FIG. 6 is a right side view of a pressing unit.

FIG. 4 is a perspective view of the belt off-set controlling mechanism portion for the unit 21 and the unit 31. The belt off-set controlling mechanism for the fixing belt 27 is disposed at the right-hand side of the unit 21. The belt off-set controlling mechanism for the pressing belt 32 is also disposed at the right-hand side of the unit 31. FIG. 5 is the right side view of the unit 21, and FIG. 6 is the right side view of the unit 31.

The belt off-set controlling mechanism for the fixing belt 27 will be described referring to FIG. 4 and FIG. 5.

Designated by 22R is a right side plate of the housing 22 of the unit 21. Designated by 62 is a sector gear provided, for up-down pivotal movement about the supporting shaft 62*a* against the right side plate 22R. Designated by 62*b* is an elongated hole portion provided in the sector gear 62. The right bearing 63 of the steering roller 26 is engaged with the elongated hole portion 62*b* for sliding movement therealong. A right end shaft portion 26*a*R of the steering roller 26 is rotatably supported on the right bearing 63. Designated by 62*c* is an urging spring for urging the right bearing provided compressed in the inside of the elongated hole portion 62*b*. The right bearing 63 is normally urged away from the driving roller 24 along the elongated hole by the spring 62*c*. The stepping motor 60 for the steering control by the steering roller 26 is provided on the right side plate 22R of the housing 22. A worm gear 61 is fixed on a rotation shaft of the motor 60. The worm gear 61 is engaged with the sector gear 62. The sector gear 62 moves up and down about the supporting shaft 62*a* in interrelation with the forward and backward rotation of the worm gear 61 by the motor 60, so that the steering roller 26 is controlled. Details thereof will be described hereinafter. Designated by 65, 66 are belt off-set sensor units as detecting means provided in right-hand side and left-hand side with respect to the widthwise direction of the fixing belt 27. Each sensor unit comprises a photo-sensor for carrying out the two-stage belt off-set sensing (position detection) therein. Details thereof will be described hereinafter. The belt off-set controlling mechanism of the fixing belt 27 has been described in the foregoing.

Designated by 24*a*R is the right end shaft portion of the driving roller 24. The right end shaft portion 24*a*R is rotatably supported by a right bearing 67 provided in a fixed position of the right side plate 22R of the housing 22. Designated by 24*a*L is a left end shaft portion of the driving roller 24. The left end shaft portion 24*a*L is rotatably supported by a left bearing provided in a fixed position of the left side plate of an unshown housing 22. Designated by 26*a*L is the left end shaft portion of the steering roller 26. The left end shaft portion 26*a*L is rotatably supported on the left bearing engaged with an elongated hole provided in the left side plate of the housing 22 for sliding movement along the elongated hole. The left bearing is normally urged away from the driving roller 24 along the elongated hole portion, similarly to the right bearing 63, by the left bearing urging spring provided compressed in the inside of the elongated hole portion. In this way, by urging the bearings of the left and right opposite end shaft portions 26*a*L, 26*a*R of the steering roller 26 away from the driving roller 24 by the urging spring, and the steering roller 26 is functioned also as a belt tension roller which gives the tension to the fixing belt 27. Designated by 26L, 26R are flanges provided in the left and right ends of the steering roller 26, which functions as a safety mechanism which is abutted by the lateral end of the belt, when the fixing belt 27 offsets too much.

The belt off-set controlling mechanism for the pressing belt 32 will be described referring to FIG. 4 and FIG. 6. Designated by 35R is a right side plate of the housing 35 of the unit 31. Designated by 72 is a sector gear provided for rotation in the up-down direction about the supporting shaft 72*a* relative to the right side plate 35R. Designated by 72*b* is an elongated hole portion provided in the sector gear 72. The right bearing 73 of the steering roller 34 is slidably engaged with the elongated hole portion 72*b*. The right end shaft portion 34*a*R of the steering roller 34 is rotatably supported by the right bearing 73. Designated by 72*c* is the right bearing urging spring provided compressed in the inside of the elongated hole portion 72*b*. The right bearing 73 is normally urged away from the driving roller 33 along the elongated hole portion by the spring 72*c*. The right side plate 35R of the housing 35 is provided with a stepping motor 80 for the steering control of the steering roller 34. A worm gear 81 is fixed on the rotation shaft of the motor 80. And, the worm gear 81 is in meshing engagement with the sector gear 72. By the sector gear 72 moving up and down about the supporting shaft 72*a* in interrelation with the start of the right reverse rotation of the worm gear 81 by the motor 80, the steering roller 34 is controlled for the steering operation. The belt off-set sensor unit as the detecting means is provided in the right-hand side and left-hand side of the pressing belt 32 (in FIG. 8), reference numerals 85, 86 similarly to the case of the fixing belt 27, and each sensor unit comprises the photo-sensor for carrying out the two-stage belt off-set sensing (position detection) therein. The belt off-set controlling mechanism of the pressing belt 32 has been described.

Designated by 33*a*R is a right end shaft portion of the driving roller 33. The right end shaft portion 33*a*R is rotatably supported by the right bearing 87 fixed to the right side plate 35R of the housing 35. The left end shaft portion of the driving roller 33 is rotatably supported by the left bearing fixed to the left side plate (unshown) of the housing 35. Designated by 34*a*L is a left end shaft portion of the steering roller 34. The left end shaft portion 34*a*L is rotatably supported on the left bearing engaged for sliding movement along the elongated hole provided in the left side plate of the housing 35. The left bearing is normally urged away from the driving roller 33 along the elongated hole portion by the left bearing urging spring provided compressed in the inside of the elongated hole portion, similarly to the right bearing 73. In this way, since the steering roller 34 gives the tension to the pressing belt 32 by urging the bearings of the left and right opposite ends shaft portions 34*a*L, 34*a*R away from the driving roller 33 by the urging springs, respectively, it is functioned also as the belt tension roller. Designated by 34L, 34R are flanges provided in the right and left ends of the steering roller 34, and when the pressing belt 32 offsets too much, it is functioned as the safety mechanism by being abutted by the end of the belt.

(4) Belt Off-Set Control Operation:

The fixing device of the twin-belt type in this embodiment is operable in two control modes, namely, a control mode A and a control mode B.

Here, angle when the steering roller (the supporting member) which stretches the belt is inclined from the state (preset state) of the reference orientation is an inclination angle. In this example, although a longitudinal direction of the steering roller is horizontal in the state of the reference orientation, the present invention is not limited to such an example. In other words, the state of the reference orientation of the steering roller may be the state of inclination by a predetermined angle relative to the horizontal direction.

Control mode A: This mode is carried out when the belt exists within the normal zone, that is, central zone with respect to the widthwise direction (FIG. 9), and, in this mode, The inclination angle of the steering roller is set to the balance angle so that the belt may be kept in this zone a balance mode. In this example, even if the longitudinal direction of the steering roller is horizontal, it is said that the "inclination" of the steering roller is set to the balance angle.

In other words, in the balance mode, the inclination angle of the steering roller is set so that offset to one side of the belt and the other side may balance with each other. When the belt exists within the normal zone, the orientation of the steering roller is the balance orientation.

About the balance angle (the state of the balance), it is set beforehand by measurement after assembly of the device, and it is stored in a non-volatile memory as storing means. The CPU 100 as the setting means reads the data corresponding to the balance angle of the memories, so that the control mode A may be carried out.

As has been described hereinbefore, the balance angle is the horizontal angle perpendicular to the direction of the gravity in this example.

Control mode B: this mode is carried out when the belt or a part thereof exists outside the normal zone, and the inclination angle of the steering roller is set to the return angle so that the belt may be returned to the normal zones return mode.

In other words, when the belt or a part thereof exists outside the normal zone, the orientation of the steering roller is set to the inclination angle for returning the belt.

In addition, the return angle (the inclined state) is set beforehand by measurement after assembly of the device, and it is stored in above described memory. The CPU as the setting means reads the data correspondingly to the return angle of the memory, so that the control mode B is carried out. The return angles are prepared for the case that the belt offsets toward one lateral end and for the case that the belt offsets toward the other lateral ends. In this example, as will be described hereinafter, the return angle for the offset toward one lateral end of the belt is the same as the return angle for the offset toward the other lateral end of the belt in absolute value; however directions thereof differ from each other.

In addition, in this example, the stabilized belt feeding is accomplished by lengthening the period of the state of the control mode A as much as possible.

More specifically, the control mode A is the mode carried out when the snaking movement of the belt is eliminated, and this mode is a balance point maintaining mode to return the steering roller to the balance angle with which the leftward and rightward snaking tendencies are substantially balanced.

Further specifically, the control mode B is the mode carried out when the snaking movement of the belt is confirmed, and this mode is a snaking motion preventing mode for inclining the steering roller to a sufficient angle to return the snaking movement to an opposite direction. In spite of carrying out the control mode A, such a snaking movement of the belt may take place due to ageing of the device, the off-set control by the other one of the belt, and so on.

The full offset error of the belt can be prevented by providing the control mode B, and in addition, the belt can be maintained for a longest possible period within the normal zone (a widthwisely central portion) by providing the control mode A.

In the twin-belt type structure where the belts are subjected to the off-set correcting operations independently from each other, the snaking movement of each belt is retarded in the state in which the belts are in contact with each other to accomplish the stabilized belt off-set control. Therefore, according to the structure of this example, the damage of the belt resulting from the full offset of the belt is prevented, and in addition, the reduction of the lifetime resulting from the off-set movement of the belt can be suppressed.

Fundamentally, the control (control mode A) in which the belt is stayed within the normal zone (the widthwisely central portion) is carried out. When the belt offsets, in spite of the execution of the control, to a lateral end portion due to the off-set movement of the other one of the belt, the control (control mode B) which pulls back the belt into the normal zone adjacent to the center of the belt operates. In other words, there are provided a mode for shifting the belt to the widthwise direction and eliminating the snaking movement, and a mode for making the shift of the belt as small as possible. As will be described hereinafter, there is provided also a mode for finely tuning the balance angle (the orientation or pose) of the steering roller for making the movement of the belt as small as possible.

The respective belt off-set controlling mechanisms for the fixing belt 27 and the pressing belt 32 have the structures which are similar to each other, as has been described in section (3) and those mechanism operations and control sequences are also similar to each other. Then, here, the belt off-set control of the fixing belt 27 will be described as a representative example.

Figure 7:
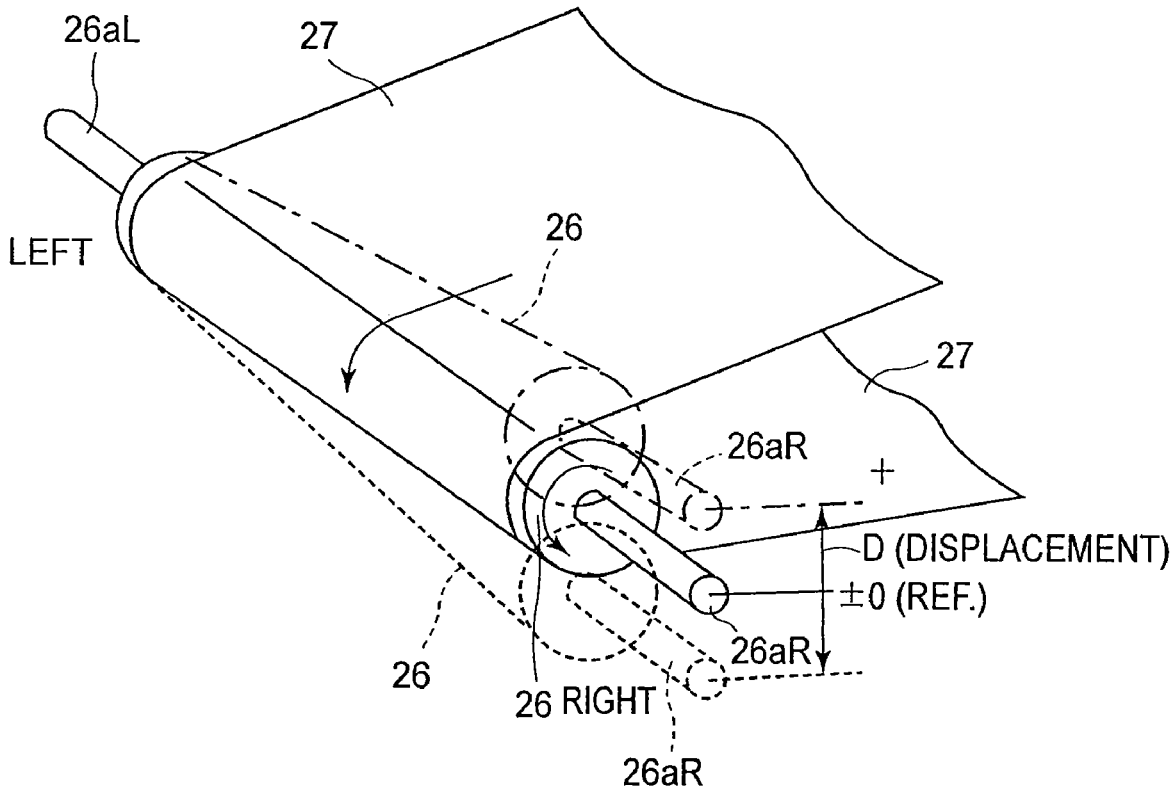
FIG. 7 illustrates a steering operation of a steering roller.

FIG. 5 and FIG. 7 will be referred to for the description. The motor 60 is driven in response to the instructions from the CPU 100 as the setting means (the control means) in the direction (clockwise) indicated by CW, and then the worm gear 61 is rotated, by which the sector gear 62 rotates downwardly about the supporting shaft 62*a*. By this the right bearing 63 of the steering roller 26 downwardly moves, so that the right end portion of the steering roller 26 drops relative to the left-hand end portion, as in an indicated by broken lines in FIG. 7. By this, since the tension becomes lower in the right side than in the left side, the fixing belt 27 is gradually moved toward the low tension side (right-hand side) along the longitudinal direction (the direction of axis of the roller) in accordance with the rotation thereof.

Conversely, if the motor 60 is rotated in direction (counterclockwise) of CCW in response to the instructions from the CPU 100, the worm gear 61 rotates, so that the sector gear 62 upwardly rotates about the supporting shaft 62*a*. This upwardly moves the right bearing 63 of the steering roller 26, so that, in the steering roller 26, the right end side goes up relative to the left end side, as indicated by chain lines in FIG. 7. By this, the tension on the left of right-hand side is low, and therefore, the fixing belt 27 is gradually moved toward the low tension side left-hand side of the tension along the longitudinal direction of the roller in accordance with the rotation thereof.

In FIG. 7, designated by D is a vertical displacement of a right end portion of above described steering roller 26. In other words, it is amount (the inclination angle) of the inclination of the steering roller 26.

If a displacement D of the end of the steering roller 26 changes, in other words, if amount (inclination angle) of the inclination of the steering roller 26 changes, it tend to move in accordance therewith in the widthwise direction to a left-hand side or right-hand side. Therefore, in order to minimize the lateral movement of the belt from a current position, a belt off-set controlling member that is, steering roller 26 employs the end displacement when the roller is substantially horizontal as a reference amount ±0. The state of this angle of the steering roller 26 provides the reference orientation.

Ideally, if the displacement D is the reference amount ±0, the belt will not shift toward right or left from this position thereof, in fact, however, due to various factors, offsetting motion may be produced, and therefore, the belt may move toward right and left relative to a stretching roller.

Although above description is made about the fixing belt control of the fixing unit 21, the description applies fundamentally also to the belt control of the pressing unit 31.

Figure 8:
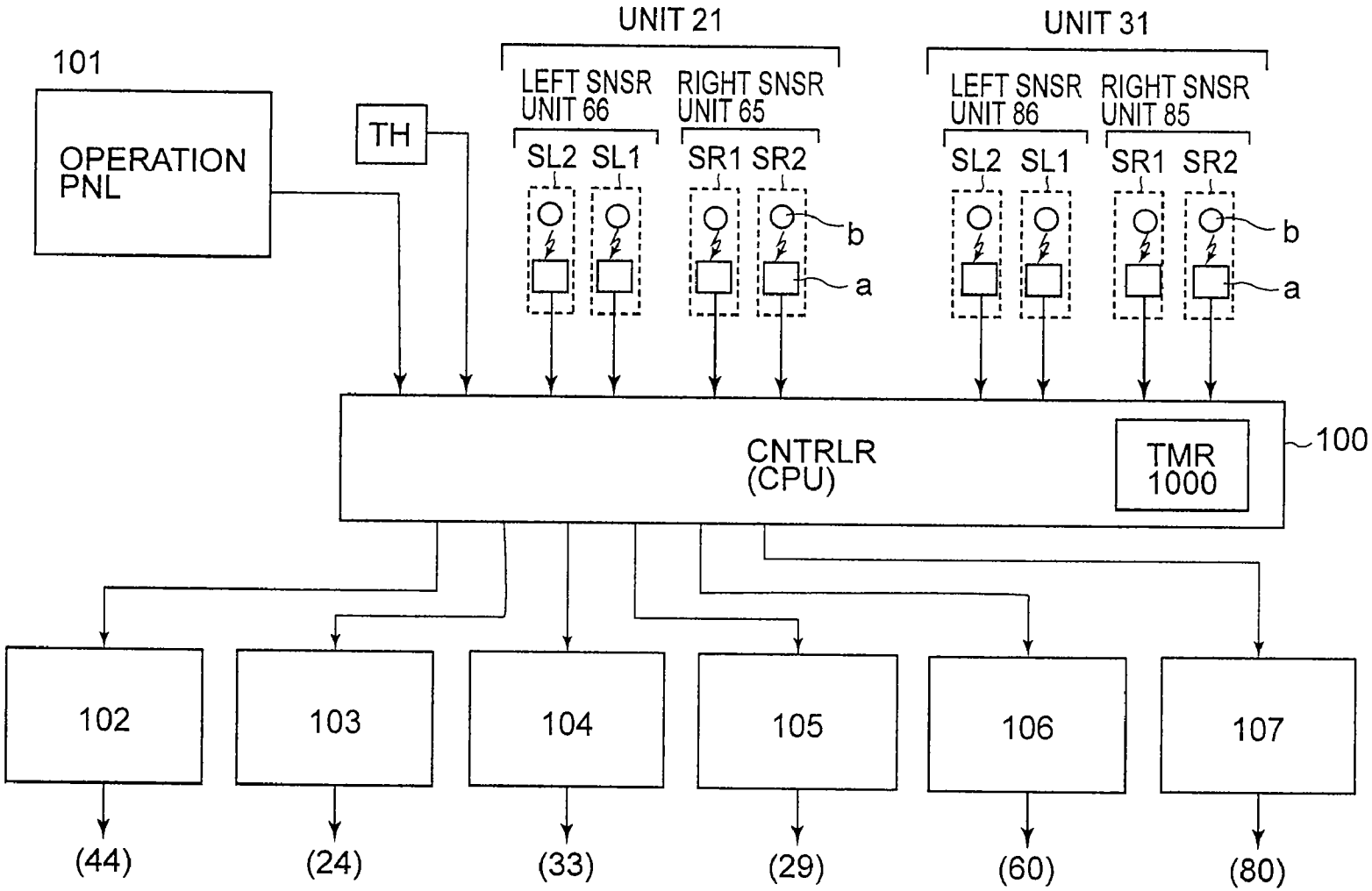
FIG. 8 is a block diagram of a control system of the fixing device.

FIG. 8 is a block diagram of a control system of the image forming apparatus which comprises the belt type fixing apparatus according to this embodiment. The CPU 100 as the setting means (the control means) govern the overall control, and the operating portion 101 which comprises a liquid-crystal-display touch screen, keys, and so on is connected therewith. The operation of the image forming apparatus is started in response to the input by the user on the operating portion 101.

The CPU 100 controls the belt mounting-dismounting mechanism 102, The driving mechanism 103 for the driving roller for the fixing belt, the driving mechanism 104 for the driving roller for the pressing belt, the excitation circuit 105, the fixing steering controlling mechanism (the motor driver) 106, the pressing steering control mechanism (motor driver) 107, and so on. The electrical temperature information is inputted to the CPU 100 from the temperature detecting element TH. The electrical information about the belt offset is inputted to the CPU 100 from the left-hand side and right-hand side belt off-set sensor units 66, 65 of the fixing unit 21, and the left-hand side and right-hand side belt off-set sensor units 86, 85 of the pressing unit 31. The sensor unit 66, 65 and the sensor unit 86, 85 each comprise sensors for sensing the positions (amounts of belt offset) of the fixing belt 27 and the pressing belt 32.

The belt engaging-disengaging mechanism 102 is the mechanism for carrying out engagement/disengagement between above described fixing unit 21 and pressing unit 31. The driving mechanism 103 for the fixing belt driving roller drives the driving roller 31 of the fixing unit 21, so that the stretched fixing belt 27 is rotated. The driving mechanism 104 for the pressing belt drive roller drives the driving roller 33 of the pressing belt of the pressing unit 31 similarly, so that the stretched pressing belt 32 is rotated. The excitation circuit 105 is the circuit for controlling the electric power supply to the induction heating coil 29, and the control circuit portion 100 on-off-controls the electric power supply to the induction heating coil 29 from the excitation circuit 105 on the basis of the electrical temperature information inputted from the temperature detecting element TH.

The fixing steering controlling mechanism 106 drives the motor 60 in accordance with the signal from the CPU 100 to correct the off-set of the fixing belt 27.

The pressing steering control mechanism 107 drives the motor 80 in accordance with the signal from the CPU 100 to correct the off-set of the pressing belt 32.

In addition, in the example which will be described hereinafter, for each 1 pulse drive of the motor 60(80), the steering roller is moved by 0.0046 (mm/pulse).

The belt off-set detecting means will be described in detail referring to FIG. 9. The mechanisms and the operations for the belt off-set sensing for the fixing belt 27 and the pressing belt 32 are fundamentally similar to each other, and therefore, the off-set sensing of the fixing belt 27 is described as a representative.

Figure 9:
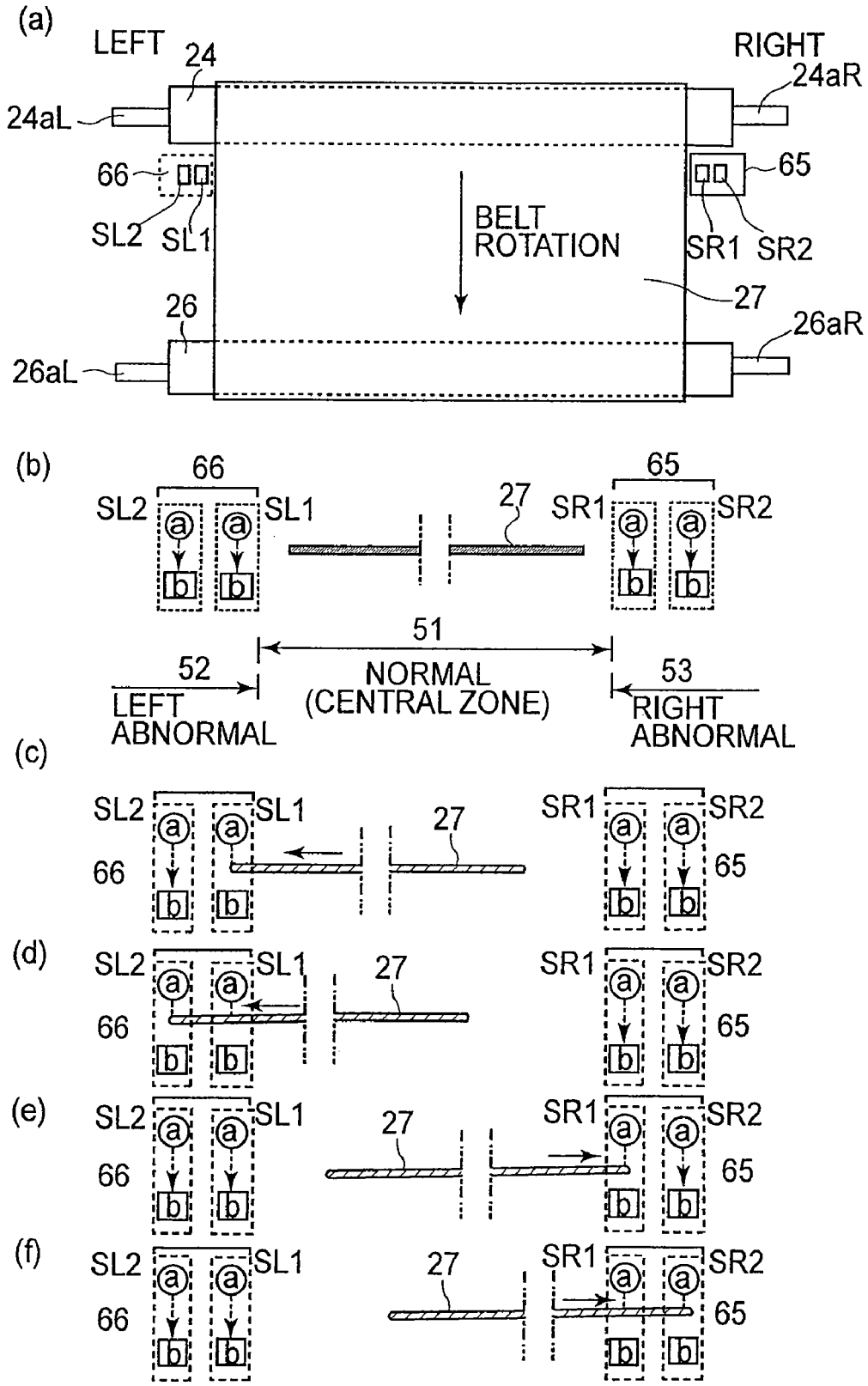
FIG. 9 illustrates a belt snaking position and a belt off-set position detecting sensor.

FIG. 9, (a) is a top plan view of a fixing belt portion between the driving roller 24 and the steering roller 26. Each of the left-hand side and right-hand side belt off-set sensor units 66, 65 comprises first sensors SL1, SR1 and second sensors SL2, SR2 which is disposed outside of the respective first sensors with a predetermined clearance therefrom, as the belt off-set detecting means. Each sensor is a photosensor type detector (photo-sensor) constituted by a couple of a light sending element a and a light receiving element b. In the process of the fixing belt rotation, when the fixing belt 27 offsets to left-hand side or right-hand side beyond in a predetermined distance, an offsetting belt edge enters between the light sending element a and the light receiving element b, blocks the optical path between them. Each sensor is turned on in the state of the open optical path releasing, and is turned off in the state of the interrupted optical path.

In FIG. 9, (a) and (b) show the state where the fixing belt 27 is rotated within the tolerance which is a range between the left-hand side first sensor SL1 and the right-hand side first sensor SR1, and in this case, both the left-hand side first sensor SL1 and the right-hand side first sensor SR1 are both ON. The CPU 100 determines that the fixing belt 27 is rotated within allowable offset range, on the basis of the ON states of these sensors SL1, SR1. The allowable offset range of the fixing belt at this time 27 is called normal offset range (central zone) 51.

The fixing belt 27 carries out the off-set movement on left-hand side, to the extent that, as shown in (c), the left-hand side first sensor SL1 may be turned OFF by the left-hand side belt edge portion, and, if this occurs, the CPU 100 determines that the fixing belt 27 offsets exceeding allowable range on left-hand side. In this case, in order to return the fixing belt 27 to reverse right-hand side, the motor 60 is driven in the direction of CW by the fixing steering controlling mechanism 106 to displace the right end portion of the steering roller 26 downwardly (the broken lines in FIG. 7).

In spite thereof, if the fixing belt 27 offsets on left-hand side further, as shown in (d), the left-hand side second sensor SL2 is also turned off by the left-hand side belt edge, and in this case, the displacement of the fixing steering roller 26 is increased further so that the right-side-down inclination of the roller 27 is increased.

When the OFF-state of the left-hand side second sensor SL2 is continued for the 10 seconds in spite of this operation, the control circuit portion of the CPU 100 stops the rotation of the driving roller 24 for the fixing belt in order to prevent the damage of the fixing belt 27. After stopping the image forming operation of the overall image forming apparatus, the CPU 100 carries out the error indication to the operating portion 101, so that the user is prompted to have him call the service person (the prompt of serviceman-calling). This left-hand side range of the fixing belt 27 is called a left abnormality range 52.

If the fixing belt 27 offsets to the right-hand side to such an extent that that the first sensor SR1 of right-hand side is turned OFF by a right-hand side belt edge as shown in (e), The CPU 100 determines that the fixing belt 27 offsets beyond the tolerance on right-hand side. In order to return the fixing belt 27 to left-hand side and, the motor 60 is driven in the direction of CCW by the fixing steering controlling mechanism 106, so that the right side end of the steering roller 26 is displaced upwardly (the chain lines in FIG. 7).

If the fixing belt 27 offsets to right-hand side further in spite of that to such an extent that that the right-hand side second sensor SR2 is also turned off by the right-hand side belt edge as in (f). In this case, the displacement of the steering roller 26 is increased further and the left-side-down inclination of the roller 27 is increased.

In the case where the OFF-state of the right-hand side second sensor SR2 continues for the 10 seconds in spite of this operation, the CPU 100 stops the rotation of the driving roller 24 of the fixing belt, for the prevention of the damage of the fixing belt 27, similarly to the case of the full offset to the left-hand side of the fixing belt 27 After stopping the image forming operation of the overall image forming apparatus, the CPU 100 carries out the error indication to the operating portion 101 to display the serviceman-calling. The right-hand side range of the fixing belt 27 here is called a left abnormality range 53.

Figure 10:
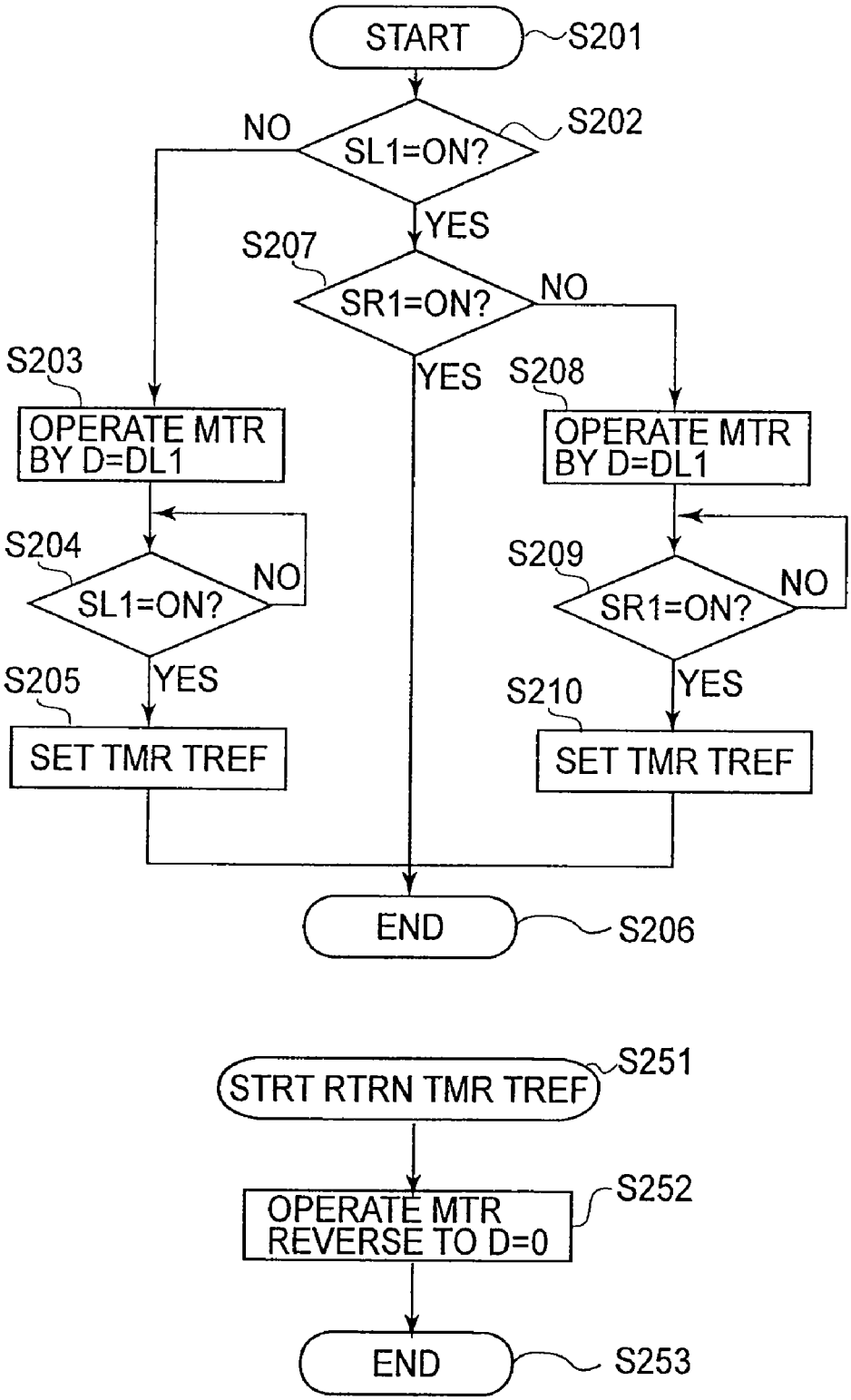
FIG. 10 is a flow-chart of control and discriminating operations when the belt offset is detected.

(5) Control Discrimination Flow:

Referring to FIG. 10, the description will be made as to the belt offset detection and the offset correction control stated in conjunction with FIG. 9, more particularly, a control discrimination flow of the CPU100 as setting means (control means). In the following description, "steering amount" is an angle by which the steering roller is inclined (or an amount of displacement thereof). In addition, "steering position" is the position, attitude, orientation or state of the steering roller at a certain angle (including zero, that is, horizontal).

According to this embodiment, as for the timing of effecting the steering control for correcting the offset of the fixing belt 27, the steering amount of the steering roller 26 is set to a predetermined inclination when the detected amount of the fixing belt offset reaches a predetermined range (±2). In addition, at the time when the fixing belt is in the central zone which is the normal range, the inclination angle of the steering roller is returned to the balance angle. More particularly, the inclination angle of the steering roller is returned to the balance angle when a set time elapses from the returning of the belt to the central zone. Thus, the control is based on the time. Furthermore, the set time is changed by the CPU100 (changing means) in accordance with the peripheral speed of the belt, that is, the rotational speed of the driving roller. This will be described in detail.

In step S201 of FIG. 10, the CPU100 carries out the process every 100 ms by an interval timer 1000 as measuring means.

In the initial state, the first and second sensors SL1, SL2 of the left-hand sensor unit 66 and the first and second sensors SR1, SR2 of the right-hand sensor unit 65 are both in ON state, and therefore, they do not detect belt offset. At this time, the displacement amount D of the end of the steering roller 26 is the reference amount which is ±0 (balance angle of the steering roller 26).

When the operation of the step S201 starts, the discrimination is made as to whether or not the first left-hand sensor SL1 is in ON state, at the step S202. If not, the operation proceeds to a step S203 where the motor 60 is driven by 400 pulses in the CW (clockwise) direction to provide the predetermined displacement amount DL1 for the steering roller 26 (return angle of the steering roller 26).

Subsequently, by the belt offset correction control in the step S203, a loop operation is continued until the first left-hand sensor SL1 is turned on (S204). When the left-hand second sensor SL2 is turned OFF during the loop operation, the displacement amount is changed again to make an additional correction, which will be described hereinafter referring to FIGS. 12 and 13.

In this example, the time elapsing from the time when the belt enters the zone is counted or measured, by a timer 1000. This will be described further.

At the instance when the first left-hand sensor SL1 returns to ON state, the position of the belt, the position of the belt is immediately downstream of the first left-hand sensor SL1 with respect to the widthwise belt motion, and therefore, the belt has not yet returned sufficiently to the central zone which is the normal range ((b) in FIG. 9). In a step S205, a timer Tref is set so that at the instance when the predetermined time elapses from this event, the motor 60 is actuated to return the displacement amount D of the steering roller 26 to the reference amount ±0.

If the first left-hand sensor SL1 is in the ON state in step S202, the discrimination is made as to whether or not the first right-hand sensor SR1 is in the ON state in step S207. Similarly to the case of the left side, if it is not ON, the operation proceeds to a step S208 where the motor 60 is driven by 400 pulses in the CCW (counterclockwise) direction to provide the predetermined displacement amount DR1 for the steering roller 26 (return angle). Subsequently, the loop operation is carried out by the belt offset correction control in a step S208 until the first right-hand sensor SR1 is turned ON (S209). At the instance when the first right-hand sensor SR1 returns to the ON state, the position of the belt is immediately downstream of the first right-hand sensor SR1 with respect to the widthwise motion of the belt, and therefore, the belt has not yet sufficiently returned to the normal range (central zone) In a step S210, the timer Tref is set so that at the instance when the predetermined time elapses, the motor 60 is actuated conversely to return the displacement amount of the steering roller 26 to ±0 (balance angle), and this is the end of the sequence operation (S206)

If the result of the discrimination in step S202 is that first left-hand sensor SL1 is ON, and the discrimination result in step S207 is that first right-hand sensor SR1 is ON, it is determined that fixing belt 27 is stabilized in the central zone ((b) in FIG. 9), and no particular control is carried out. This is the end of the sequence operation (step S206)

The timer Tref set in the step S205 and step S210 actuates a timer handler in step S251 when the predetermined time elapses.

Subsequently, in step S252, when the timer is set in step S205, the motor 60 is reversely rotated by 400 pulses in the CCW direction so as to provide the displacement amount D=±0. When the timer is set in step S210, the motor 60 is actuated by 400 pulses in the CW direction. This is the end of the operation of the timer handler (step S253)

Figure 11:
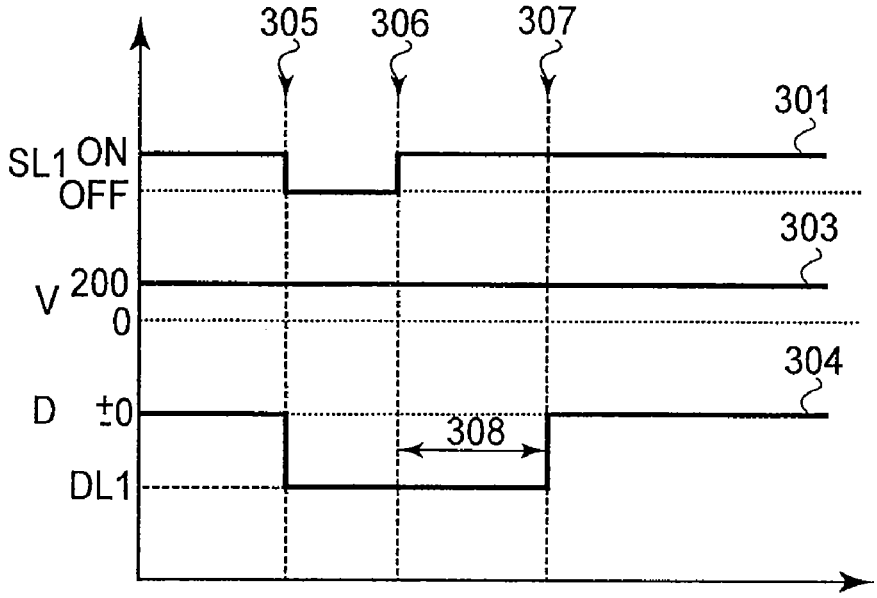
FIG. 11 is a diagram showing timing of correction control when the belt offset is detected.
Figure 11:
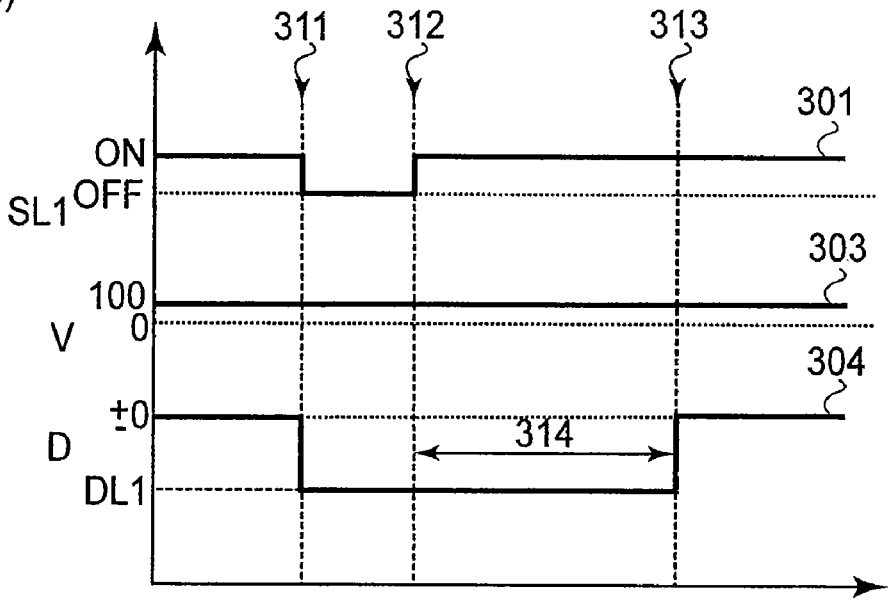

Referring to FIG. 11, the description will be made as to the timing and the control amount of the belt offset detection and the offset correction control which have been described with FIG. 9.

In FIG. 11, (a) is a timing chart of the correction control when the fixing belt 27 offsets in the leftward direction to such an extent that first left-hand sensor SL1 is rendered OFF, wherein the belt moves from the position of (b) of FIG. 9 to the position of (c) and then returns to (b).

In (a) of FIG. 11, designated by 301 is a diagram showing ON (non-detection) and OFF (detection) of the first left-hand sensor SL1 which are supplied to the CPU100. Similarly, designated by 303 is a diagram showing the rotational speed of the driving roller 24 controlled by the output signal of the CPU100, and it is set at 200 mm/sec. Designated by 304 is a diagram of the displacement amount of the steering roller 26 controlled by the output signal from the CPU100.

When the first left-hand sensor SL1 is rendered OFF at a point 305, the CPU100 rotates the motor 60 by the predetermined number of pulses in the CW direction, and sets the displacement amount D of the steering roller 26 to the predetermined value DL1 in the negative direction than the reference amount ±0 (return angle). By this, the steering roller 26 is inclined to the right, so that left-hand offset is gradually corrected, and at a point 306, the first left-hand sensor SL1 is turned ON.

At this time, left-hand end of the fixing belt 27 is still in the neighborhood of the first left-hand sensor SL1. Therefore, the displacement amount DL1 is maintained until the time 308 elapses, which is the time duration in which the fixing belt 27 is expected to reach substantially the center of the central zone which is between the sensors SL1 and SR1. When the time 308 elapses at a point 307, the motor 60 is rotated by the predetermined pulses in the CCW direction to return the displacement amount D of the steering roller 26 to the reference amount ±0 (balance angle). The time duration 308 for returning the displacement amount D of the steering roller 26 to the reference amount ±0, is calculated on the basis of the displacement amount D until the displacement amount D is returned to the reference amount ±0 and of the rotational speed of the fixing belt 27. For example, when DL1=2.0 mm, and the belt rotational speed is 200 mm/sec, the time duration is 10 sec.

In FIG. 11, (b) is a timing chart of the correction control when the fixing belt 27 moves to the left, to the extent that first left-hand sensor SL1 is turned OFF. The different from the case of (a) is that rotational speed of the driving roller 24 indicated by 303 is 100 mm/sec.

In the case of (b) of FIG. 11, similarly to the case of (a), when the first left-hand sensor SL1 is turned OFF at a point 311, the CPU100 rotates the motor 60 by a predetermined number of pulses in the CW direction to set the displacement amount D of the steering roller 26 to DL1. By this, the steering roller 26 inclines to the right, so that offset of the belt is gradually corrected, and the first left-hand sensor SL1 is turned ON at a point 312.

At this time, left-hand end of the fixing belt 27 is still in the neighborhood of the first left-hand sensor SL1. Therefore, the displacement amount DL1 is maintained until the time 308 elapses, which is the time duration in which the fixing belt 27 is expected to reach substantially the center of the central zone, and when the time elapses, the displacement amount D of the steering roller 26 is returned to the reference amount ±0.

The time 314 for returning the displacement amount D to the reference amount ±0 is longer than in the case of (a) of FIG. 11 (200 mm/sec) since if the rotational speed of the fixing belt 27 is low, the time required for the belt to return the center portion of the central zone is long. More particularly, the time 314 is slightly less than approx. 2 times the time 308, and when the belt rotational speed is 100 mm/sec, it is 18 sec.

An example will be described wherein the offset of the fixing belt 27 does not return sufficiently despite setting the displacement amount D of the steering roller 26 to DL1 and providing the predetermined inclination angle.

Since the belt moves to the left until the first left-hand sensor SL1 is turned OFF, the offset of the belt is supposed to be eliminated normally by rotating the fixing belt 27 with the setting of the displacement amount of the steering roller 26 at DL1. However, with the long term use of the belt which may wear it, the belt offset correction may not work properly.

Figure 12:
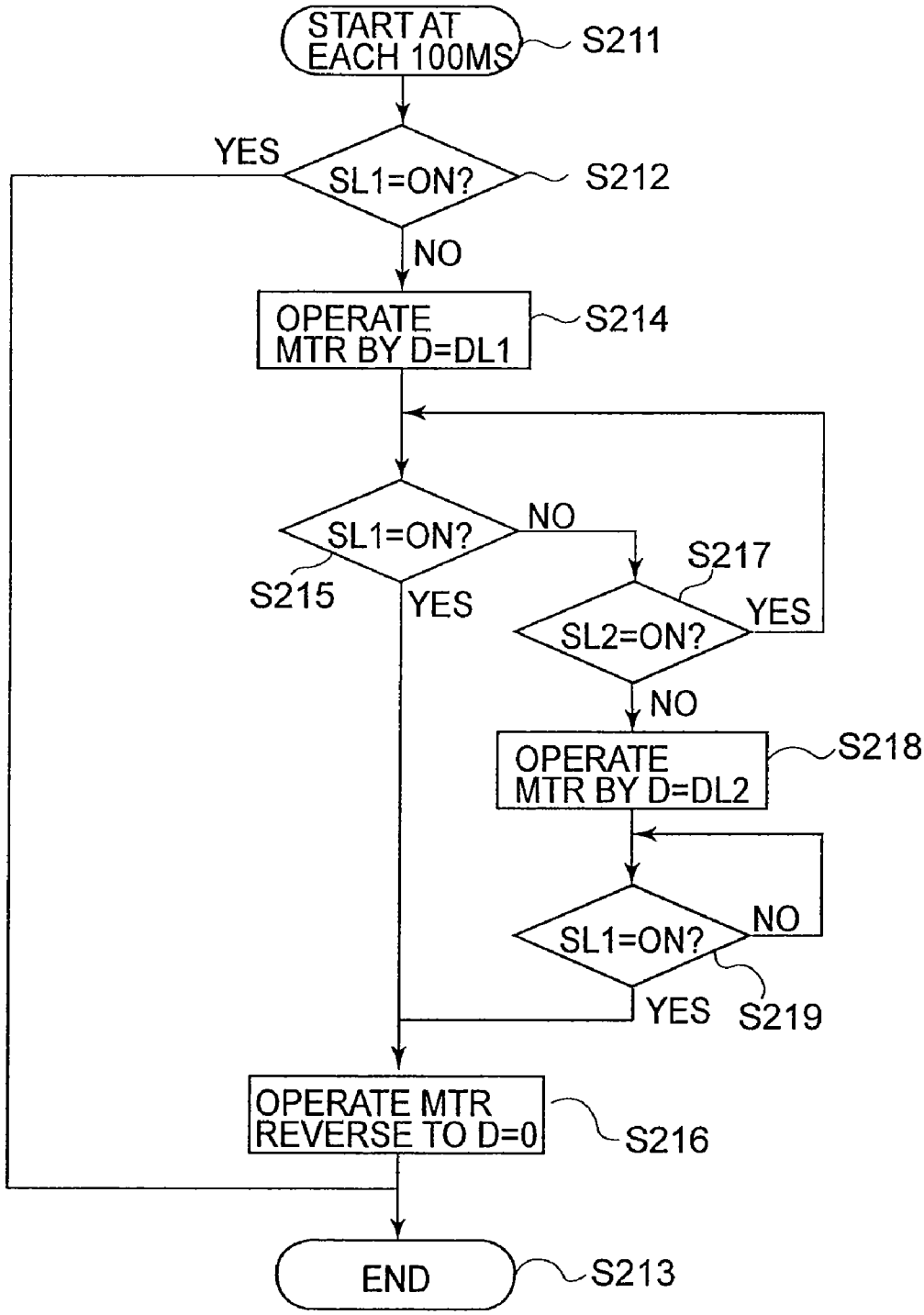
FIG. 12 is a flow-chart of control and discriminating operation when the belt offset advances despite execution of a belt offset correcting operation.

FIG. 12 is a control flow chart which works when the belt offset is to such an extent to the left-hand second sensor SL2.

The operations of step S211 to step 216 in FIG. 12 the same as the described case wherein the belt offset is eliminated by setting the displacement amount of the steering roller 26 to DL1 when the belt turns the first left-hand sensor SL1 OFF. This portion is the same as the steps S201 to S205, and the description thereof is omitted for simplicity.

In step S214, the control waits for the first left-hand sensor SL1 to become ON after the displacement amount of the steering roller 26 is changed to DL1. In this state, there is a possibility that offset continues to the left-hand second sensor SL2 rather than being eliminated, and therefore, the confirmation is made as to whether the left-hand second sensor SL2 is ON in step S217.

If the detected state of the left-hand second sensor SL2 is ON, it is discriminated that left-hand end of the belt is between the first left-hand sensor SL1 and the left-hand second sensor SL2, and therefore, the control waits for the first left-hand sensor SL1 to become OFF.

If the detected state of the left-hand second sensor SL2 is OFF, it is discriminated that offset of the fixing belt 27 further advances to the left. Therefore, the end displacement amount D of the steering roller 26 is set to DL2=4.0 mm by actuating the motor 60 by the amount corresponding the difference amount from the current displacement amount DL1. The number of the pulses of the motor 60 required for the displacement from the ±0 to DL2 is 110, and therefore, the motor 60 is rotated by 50 pulses (difference) further in the CW direction.

When the first left-hand sensor SL1 is turned ON, the position of the belt is immediately adjacent the first left-hand sensor SL1, and therefore, the returning to the center portion position of the central zone is not sufficient. For this reason, the timer Tref is set for reversely rotating the motor 60 to return the displacement amount D of the steering roller 26 to ±0 after elapse of the predetermined time in step S216, and this is the end of the sequential operation.

Figure 13:
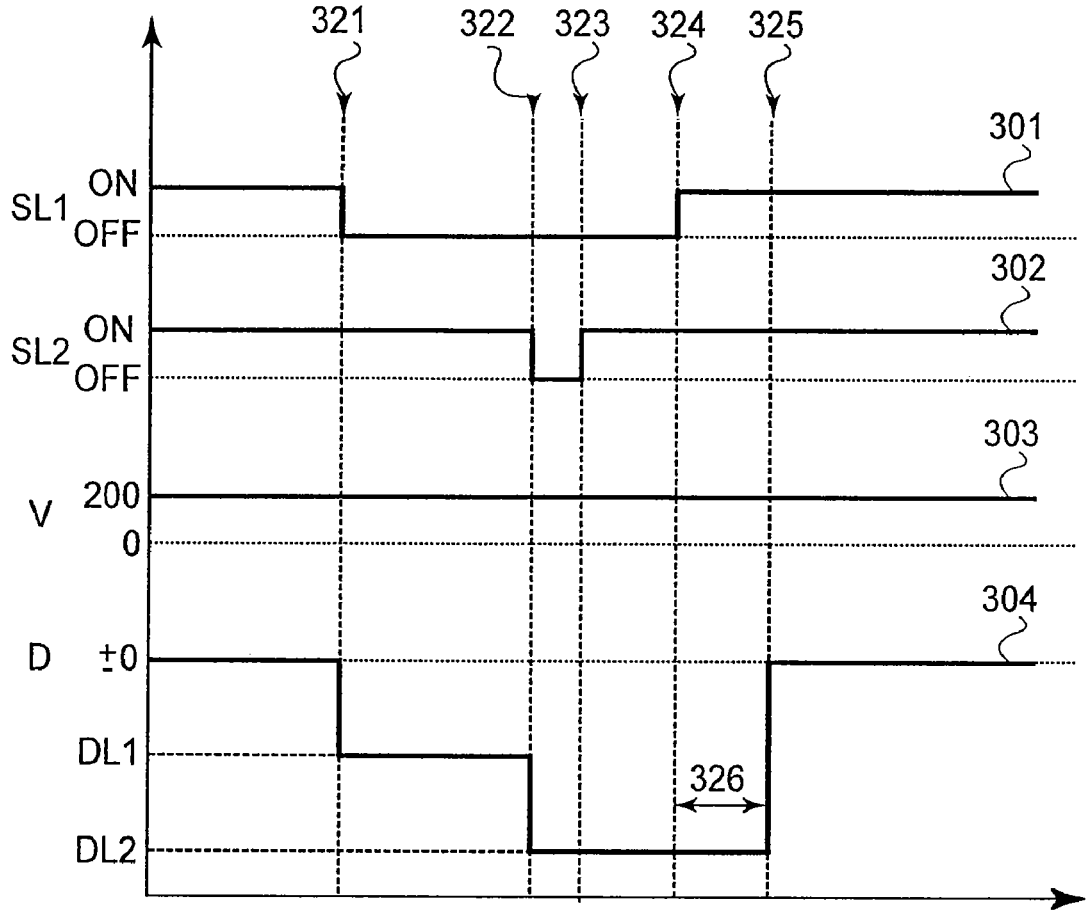
FIG. 13 is a diagram showing timing of correction control when the belt advances despite execution of a belt offset correcting operation.

FIG. 13 is a timing chart dealing with the case in which the fixing belt 27 moves to the left, and the offset control is effected in accordance with the OFF signal of the first left-hand sensor SL1, and thereafter, a further offset control is effected in response to a detection of OFF signal from the left-hand second sensor SL2.

In the initial state shown in the, the first left-hand sensor SL1 and the left-hand second sensor SL2 are both in ON state. With rotation of the fixing belt 27, the belt offsets sooner or later to the left, for example, as shown in (c) of FIG. 9, and then the motor 60 is rotated by the predetermined number of pulses in the CW direction. More particularly, as indicated by the point 321, the motor 60 is rotated by the predetermined number of pulses in the CW direction to provide the negative predetermined value DL1 for the displacement amount D of the steering roller 26.

However, the belt may continue to offset to the left, to such an extent that left-hand second sensor SL2 is turned off as shown in (d) of FIG. 9 (point 322). On such an occasion, in order to correction the belt offset with a stronger correcting force, the motor 60 is rotated by the difference so as to set the displacement amount D of the steering roller 26 to a predetermined value DL2 which is larger than the predetermined value DL1.

Thus, the belt now begins to return, and then, the left-hand second sensor SL2 is first turned on (point 323), but if the displacement amount D of the steering roller 26 is returned to DL1 at this time, there is a possibility that belt begins to offset, and therefore, the displacement amount DL2 is retained.

When the belt is sufficiently returned, the first left-hand sensor SL1 is turned ON, but the displacement amount D of the steering roller 26 is still kept at DL2. At the time when the fixing belt 27 is supposed to be substantially in the center portion of the central zone between the sensor SL1 and the sensor SR1, the motor 60 is rotated in the opposite direction by the predetermined number of pulses. More particularly, the motor 60 is rotated reversely to return the displacement amount D of the steering roller 26 to the reference amount ±0.

Since the displacement amount DL2 is larger than the displacement amount DL1, the distance of movement of the belt through which the belt moves in the widthwise direction per unit time is larger when the displacement amount of the steering roller 26 is DL2 then when it is DL1. Therefore, the time from the returning of the first left-hand sensor SL1 to the ON state to the arrival of the belt at substantially the center portion is shorter with the displacement amount DL2 than with the displacement amount DL1. Therefore, it is desirable that time 326 is shorter than the time 308: 10 sec) in the case of (a) of FIG. 11. In this example, DL2=4.0 mm, the belt rotational speed is 200 mm/sec, and the time 326 is 7 sec.

The control of FIG. 11-FIG. 13 described above is concerned with the case in which the fixing belt 27 is offset to the left, but the same applies to the case that fixing belt 27 offsets to the right.

In addition, the belt offset detection and the offset correction control for the pressing belt 32 in the pressing unit 31 is similar to the belt offset detection and the offset correction control for the fixing belt 27 in the fixing unit 21.

As described in the foregoing, in the structure having the sensors at the respective widthwise ends of the belt, the displacement amount of the steering roller for correcting the belt offset is changed at the time of detection, and thereafter, it is returned. In such a case, the displacement amount is returned to the reference value (balance angle) after the time which is supposed to be enough for the belt to the center position (central zone) as counted from the passing of the belt end by the first stage sensor elapses. Therefore, the deterioration which may result from frequent widthwise movement of the belt can be suppressed. In addition, it is unnecessary to provide an additional detecting mechanism for detecting the returning of the belt to the central zone without losing the proper performance of the belt offset control.

In addition, the set time for switching the inclination angle of the steering roller from the return angle to the balance angle is changed on the basis of the displacement amount of the steering roller (inclination angle of the steering roller) and the rotational speed of the belt. Therefore, the apparatus according to this embodiment can be used under various operating condition with a stabilized belt feeding.

In this example, the set time is calculated by multiplying a coefficient which is different in accordance with the peripheral speed of the belt and the steering amount under the conditions of the following peripheral speeds of the belt (driving roller):

200 mm/sec steering amount K×1.0 mm/sec:

100 mm/sec steering amount K×0.55 mm/sec (for thick sheets):

70 mm/sec steering amount K×0.3 mm/sec (stand-by).

In the foregoing description, the start timing of the timer is the point of time at which the belt enters the zone (the point of time of the departure of the belt from the detection region of the first stage offset sensor SL1 (SR1), but this is not inevitable to the present invention, and the following example is an alternative.

The timer starting time may be the point of time at which the steering roller 26 is inclined in order to return the belt into the zone when the belt is deviated from the widthwisely central zone. Since, however, there is a liability that belt do not immediately return into the zone, the start timing of the timer is preferably the point of time when the belt enters the zone.

Embodiment 2

Referring to FIG. 8 which is a block diagram of the control system, the description will be made as to engagement/disengagement of the belt fixing device 12.

When the unit 21 and the unit 31 are in engagement state referring to each other as shown in FIG. 1, the fixing belt 27 and the pressing belt 32 are press-contacted to each other, so that wide fixing nip N is formed therebetween, as measured in the sheet feeding direction.

The CPU100, during the heat fixing operation for a recording material P, controls the belt engaging and disengaging mechanism 102 to provide the engagement state forming the fixing nip N.

In addition, the CPU100 during stand-by state of the image forming apparatus controls the belt engaging and disengaging mechanism 102, and as shown in FIG. 3, retains the disengagement state of the unit 21 and the unit 31. By this, the pressing belt 32 and the fixing belt 27 are kept in the non-contact state, so that thermal loss of the fixing belt attributable to the pressing belt 32 contacted thereto is reduced.

In preparation for the case in which the time to the entrance of the recording material P into the fixing nip, the CPU100 switches the fixing device 12 to the disengagement state during the image forming operation (print job operation).

The CPU100 controls, in response to an image formation start signal, the belt engaging and disengaging mechanism 102 to switch the fixing device 12 to the engagement state, thus bring the outer surface of the pressing belt 32 into contact to the lower surface of the fixing belt 27. In addition, the CPU controls the fixing belt driving roller driving mechanism 103 and the pressing belt driving roller driving mechanism 104 to rotate the fixing belt 27 and the pressing belt 32 at 200 mm/s matching the feeding speed of the recording material P. Furthermore, the CPU controls the excitation circuit 105 to supply the electric power to the induction heating coil 29, thus raising the temperature of the fixing belt 27. The surface temperature of the fixing belt 27 is detected by a temperature detecting element TH, and the temperature detection signal is inputted to the CPU100. The CPU100 controls the excitation circuit 105 so that temperature detection signal inputted from the temperature detecting element TH maintained at the detection level corresponding to the predetermined fixing temperature by changing the electric power supply to the induction heating coil 29, by which the temperature of the surface of surface of fixing belt 21 is maintained at the proper level.

Subsequently, a recording material P carrying an unfixed toner image is introduced from the secondary transfer portion 8 into the fixing nip N of the fixing device 12. The unfixed toner image surface of the recording material P is close-contacted to the surface of the fixing belt 27 in the nip, and the toner image is heated by the heat from the fixing belt 27 so that toner image is fixed on the surface of the recording material P by heat and pressure, and thereafter, the recording material P is fed out to the flapper 13.

Figure 14:
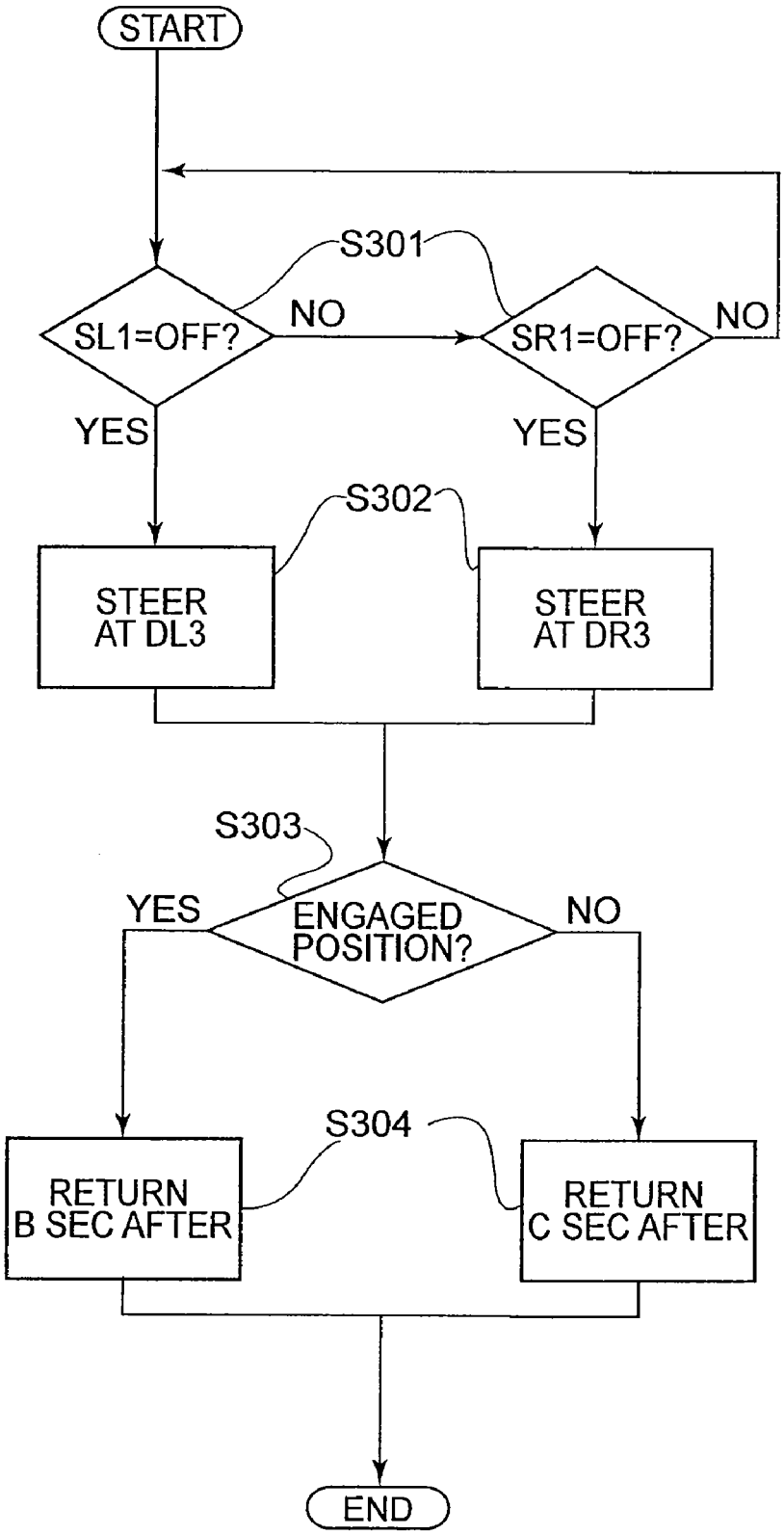
FIG. 14 is a flow-chart showing the belt offset correction control according to Embodiment 2 of the present invention.

Referring to FIG. 14, the description will be made as to the relation between engagement/disengagement control of the fixing device 12 and the offset controls for the fixing belt and the pressing belt which have been described with FIG. 9. FIG. 14 a flowchart of the operation for determining the continuing time (corresponding to the above-described set time) of a displacement of the steering roller by the CPU100 in the engagement state (FIG. 1) and the disengagement state (FIG. 3) of the belt fixing device 12.

In this example, as is different from Embodiment 1, the timer operation starts at the point of time when the steering roller 26 (34) is inclined in order to return the belt into the zone when the belt is deviated in the widthwise direction from the central zone. This will be described further.

Operations of the control are substantially the same as with the fixing unit 21 or the pressing unit 31. The following descriptions are made for both cases (the fixing belt 27 and the pressing belt 32, and the fixing steering roller 26 and the pressing steering roller 34, although the offset movements of the fixing belt 27 and the pressing belt 32 occur independently, and therefore, the actual control operations are carried out independently.

First, the discrimination is made as to whether or not the belt 27 (32) is offset to the left or right. More particularly, the discrimination is made as to whether or not the first left-hand sensor SL1 is OFF and whether or not the first right-hand sensor SR1 the OFF, an operation proceeds to a step S302. At this time, the steering roller 26 (34) is at the reference amount ±0 (balance angle).

In a step S302, displaces the steering roller 26 (34) to a predetermined displacement amount (return angle) on the basis of the discrimination in the step S301 to return the belt 27 (32) into the central zone. The displacement amount of the steering roller 26 (34) (=inclination amount) is a movement amount provided by driving the motor 60 positioned at the end of the steering roller 26 (34). In this example, the movement distance (mm) of the extreme lateral end of the steering roller 26 (34) in the perpendicular direction a reference position (distance or amount is zero). More particularly, when a left side offset of the belt is detected, DL3=3.0 mm, and when the righthand side offset of the belt is detected, DR3=−3.0 mm (3.0 mm in the downward direction).

Subsequently, in step S303, the discrimination is made as to whether or not the relative position between the fixing belt 27 and the pressing belt 32 is the engagement state (contact state) or the disengagement state (non-contact state) In step S304, depending on the result of the discrimination, the set time (sec) until the displacement of the steering roller 26 (34) is returned to the reference state (balance angle) is different. More particularly, in the case of the engagement state, it is 10 sec, and in the case of disengagement state, it is 5 sec.

The reason for the difference is that in the case of the disengagement state, there is no influence from the other roller to which it contacts as compared with the case of a state, and therefore, the returning speed of the belt (the fixing belt 27 or the pressing belt 32) is high. Therefore, the time required until the displacement is returned is shorter in the case of disengagement than in the case of engagement state.

As described above, the timing of returning the displacement of the steering roller 26 (34) is changed depending on whether the belt is influenced by the other belt, more particularly, whether they are contacted to each other or not, thus assuring the belt to return the central (normal) position. For this reason, a stabilized belt offset control is accomplished.

In above-described example, both the fixing unit and the pressing unit comprise the endless belts, respectively; however, the present invention is not limited to such a structure. The present invention is applicable if at least one of the fixing unit and the pressing unit comprises the endless belt.

For example, the fixing unit is the structure which is the structure provided with not the endless belt but the well-known a fixing roller that and, the pressing unit comprises the endless belt and the feeding device which feeds this. Even if it is with such a structure, the deterioration due to the sliding with a stretching roller and the fixing roller by the control for returning the belt to the central zone can be suppressed.

In above-described example, the steering roller is inclined by displacing one end side about the other end side; however, the present invention is not limited to such a structure.

For example, the present invention can apply the steering roller also as the structure that steering roller is inclined, by displacing one an end and other end side to an opposite direction on the basis of a longitudinally central portion thereof.

Although the roller is used as the supporting member for controlling the position with respect to the widthwise direction of the belt in above-described example, the present invention is not limited to such a structure.

For example, a fixing member, such as a pad fixed non-rotatably, may be used instead of the steering roller.

According to the embodiment described above, the deterioration of the belt can be suppressed and the belt can be fed stably. Since the steering roller is inclined only when the belt separates from the central zone, the operation frequency of a driving source for displacing the steering roller can be reduced, and an electric energy consumption of the driving source can be saved. Since the frequency of noise due to the operation of the driving source decreases, this embodiment is advantageous also from the viewpoint of the usability.

Since the time duration to move the belt to the widthwise direction thereof decreases remarkably as compared with the structure of the conventional swing-type-control, a snaking motion control of one of the belt can suppress the influence to the snaking motion control to the other one of the belt.

In addition, such a belt control can be accomplished without additionally providing a mechanism for detecting the returning of the belt to the center position of the central zone. Therefore, the apparatus can be downsized, and the cost reduction can be achieved.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 183786/2006 filed Jul. 3, 2006 which is hereby incorporated by reference.

What is claimed is:

1. A belt feeding apparatus comprising:

an endless belt;

a supporting member that rotatably supports said belt;

setting means for setting an inclination angle of said supporting member to a return angle to return said belt toward a widthwise normal zone, and for setting the inclination angle of said supporting member to a balance angle to keep said belt in the widthwise normal zone;

detecting means for detecting the deviation of said belt from the widthwise normal zone, wherein said setting means switches the inclination angle of said supporting member from the balance angle to the return angle, wherein the return angle for a first deviation of said belt is larger than the return angle for a second deviation of said belt which is smaller than the first deviation of said belt;

a steering controlling mechanism for rotating said belt in a state in which the inclination angle is the return angle for a set time after said belt reaches the widthwise normal zone from the deviated zone, and after the elapse of the set time the inclination angle is returned from the return angle to the balance angle; and rotation time setting means for determining the setting time such that a first setting time at the time when the return angle is a first angle is shorter than a second setting time at the time when the return angle is a second angle which is smaller than the first angle.

2. A belt feeding apparatus according to claim 1, wherein said setting means changes the return angle of said supporting member in accordance with a distance between said belt and the normal zone.

3. An apparatus according to claim 1, further comprising another rotatable endless belt which is press contactable to said belt.

4. An apparatus according to claim 3, further comprising another supporting member for supporting said another belt, and setting means for setting, when said another belt is deviated from another widthwise normal zone, an inclination angle of said another supporting member to a return angle to return said another belt toward said another widthwise normal zone, and for setting, when time from said another belt reaching said another widthwise normal zone reaches a set time, the inclination angle of said another supporting member to a balance angle to keep said another belt in said another widthwise normal zone.

5. An apparatus according to claim 1, wherein said rotation time setting means sets a time duration from said detecting means not detecting deviation of said belt to returning of the inclination angle to the balance angle from the return angle.

6. An apparatus according to claim 1, wherein rotation time setting means determines the set time on the basis of a peripheral speed of said belt.

7. An apparatus according to claim 1, wherein said detecting means includes a first belt detecting member provided on each of opposite sides of said belt with respect to its widthwise direction, and the widthwise normal zone is a zone in which neither of said first detecting members detects said belt.

8. An apparatus according to claim 7, further comprising a second belt detecting member further outside each first belt detecting member, respectively, wherein said setting means sets an inclination angle at the time said second belt detecting member detects the belt, at a level which is larger than an inclination angle at the time one of the second belt detecting members does not detect said belt and the corresponding first detecting member detects said belt.

9. A belt feeding apparatus comprising: an endless belt;

driving means for driving said endless belt at a first speed and at a second speed which is lower than the first speed in a rotational direction of said endless belt;

a supporting member that rotatably supports said belt;

setting means for setting an inclination angle of said supporting member to a return angle to return said belt toward a widthwise normal zone, and for setting the inclination angle of said supporting member to a balance angle to keep said belt in the widthwise normal zone;

detecting means for detecting the deviation of said belt from the widthwise normal zone, wherein said setting means switches the inclination angle of said supporting member from the balance angle to the return angle when said detecting means detects the deviation of said belt;

a steering controlling mechanism that rotates said belt in a state in which the inclination angle is the return angle for a set time after said belt reaches the widthwise normal zone from the deviated zone, and after the elapse of the set time, the inclination angle is returned from the return angle to the balance angle; and rotation time setting means for determining the setting time such that a first setting time at the time of the first speed is shorter than a second setting time at the time of the second speed.

10. An apparatus according to claim 9, further comprising another rotatable endless belt which is press contactable to said belt.

11. An apparatus according to claim 10, further comprising another supporting member that supports said another belt, and setting means for setting, when said another belt is deviated from another widthwise normal zone, an inclination angle of said another supporting member to a return angle to return said another belt toward said another widthwise normal zone, and for setting, when time from said another belt reaching said another widthwise normal zone reaches a set time, the inclination angle of said another supporting member to a balance angle to keep said another belt in said another widthwise normal zone.

12. An apparatus according to claim 9, wherein said rotation time setting means sets a time duration from said detecting means not detecting the deviation of said belt to returning of the inclination angle to the balance angle from the return angle.

13. An apparatus according to claim 9, wherein said rotation time setting means determines the set time on the basis of a peripheral speed of said belt.

14. An apparatus according to claim 9, wherein said detecting means includes a first belt detecting member provided on each of opposite sides of said belt with respect to its widthwise direction, and the widthwise normal zone is a zone in which neither of said first belt detecting members detects said belt.

15. An apparatus according to claim 14, further comprising a second belt detecting member further outside each first belt detecting member, respectively, wherein said setting means sets an inclination angle at the time said second belt detecting member detects the belt, at a level which is larger than an inclination angle at the time one of the second belt detecting members does not detect said belt and the corresponding first detecting member detects said belt.

* * * * *